US008388504B2

(12) United States Patent
Ellis

(10) Patent No.: US 8,388,504 B2
(45) Date of Patent: Mar. 5, 2013

(54) MOMENT ARM WEIGHT RESISTANCE MECHANISM AND WEIGHT TRAINING MACHINES UTILIZING THE SAME

(76) Inventor: Joseph K. Ellis, Ocala, FL (US)

( * ) Notice: Subject to any disclaimer, the term of this patent is extended or adjusted under 35 U.S.C. 154(b) by 0 days.

(21) Appl. No.: 13/179,487

(22) Filed: Jul. 9, 2011

(65) Prior Publication Data

US 2012/0004081 A1 Jan. 5, 2012

Related U.S. Application Data

(63) Continuation-in-part of application No. 11/828,454, filed on Jul. 26, 2007, now Pat. No. 7,976,441.

(51) Int. Cl.
*A63B 21/00* (2006.01)

(52) U.S. Cl. ..... 482/97; 482/100

(58) Field of Classification Search ..... 482/97, 482/93, 99, 121, 139, 94, 135
See application file for complete search history.

(56) References Cited

U.S. PATENT DOCUMENTS 4,407,495 A * 10/1983 Wilson ..... 482/97
4,502,681 A * 3/1985 Blomqvist ..... 482/130
4,863,161 A * 9/1989 Telle ..... 482/97
7,278,958 B2 * 10/2007 Morgan ..... 482/97

* cited by examiner

*Primary Examiner* — Jerome W Donnelly
(74) *Attorney, Agent, or Firm* — Laurence P. Cotton; Smith Risley Tempel Santos LLC

(57) ABSTRACT

A weight training machine having a moment arm weight resistance mechanism for creating a weight resistance or weight load.

26 Claims, 23 Drawing Sheets

MOMENT ARM WEIGHT RESISTANCE MECHANISM AND WEIGHT TRAINING MACHINES UTILIZING THE SAME

STATEMENT OF RELATED APPLICATIONS

This application is a continuation-in-part and claims the benefit of U.S. patent application Ser. No. 11/828,454 having a filing date of 26 Jul. 2007.

BACKGROUND OF THE INVENTION

1. Technical Field

This invention relates to the general technical field of exercise, physical fitness and physical therapy equipment and machines and to the more specific technical field of a moment arm weight resistance mechanism to generate weight resistance for such weight training equipment and machines.

2. Prior Art

Exercise, physical fitness and physical therapy equipment and machines are available in various configurations and for various purposes, and are available for all of the major muscle groups. The majority of such equipment and machines, especially in the exercise field, concentrate either on an aerobic or anaerobic workout or on areas of the body such as the legs, the hips and lower torso, the chest and upper torso, the back, the shoulders and the arms.

Generally, such equipment and machines can be categorized into three broad categories: free weights, mechanically operated single action resistance machines, and electrically operated resistance machines. Mechanically operated single action resistance machines can be subcategorized into three broad categories: stack weight resistance operated, free weight resistance operated, and alternative resistance operated. Mechanically operated single action resistance machines are available for exercising, strengthening and rehabilitating various individual muscles, muscle groups, combinations of muscle groups, joints, and other parts of the body.

There are physical fitness and physical therapy equipment and machines having alternative weight resistance devices. One example is disclosed in U.S. Patent Publication No. 20060105889 to Webb and assigned to Nautilus, Inc., which discloses an exercise machine having a rotatable weight selection index that is rotated to operably couple the exercise member to at least one weight plate such that the displacement of the exercise member causes the displacement of the weight plate. This device has a plurality of weight plates and the index allows the selection of different combinations of weight plates for operable coupling to the exercise member. Other examples are the BOWFLEX® brand line of products offered by Nautilus, Inc., which incorporate flexible rods and spiral devices to produce a weight resistance.

U.S. Pat. No. 4,257,593 to Keiser discloses a pneumatic exercising device including a source of gas and a pneumatic resisting mechanism connected to the source of gas and operable to compress gas received from the source to provide a resistance to movement. In other words, this device uses a pneumatic weight resistance mechanism.

Other alternative weight resistance mechanisms include hydraulic cylinders and electromagnetic devices. Several examples of such mechanisms are shown on a brochure put out by the American College of Sports Medicine entitled Selectively and Effectively Using Home Weights.

This inventor previously has developed a composite motion movement machine for use in connection with exercise and physical therapy equipment. U.S. Pat. No. 6,264,588 discloses this composite motion movement machine, which combines a moving actuating member and a moving user support, the composite motion movement machine having a support member, a frame on which the user support is located, the frame being pivotally connected to the support member, a truck in slidable engagement with the support member and the frame, an actuating member being pivotally connected to the support member and operatively connected to the truck, the actuating member being adapted to move between a first position and a second position, and a linking mechanism operatively connecting said actuating member with said truck, wherein, when the user moves the actuating member between the first position and the second position, the truck moves along rails on the support member, forcing the frame to pivot relative to the support member and causing the user to actuate a resistance weight, thus exercising, strengthening or rehabilitating certain of the user's muscles. This machine can be used in connection with a variety of different weight resistance mechanism, such as stack weights, free weights, and alternative weight resistance devices.

U.S. Pat. No. 6,287,241 discloses this inventor's improvement on leg press exercise apparatuses by utilizing composite motion movement combined with a moving actuating member and a moving user support, the leg press having a support member, a frame on which the user support is located, the frame being pivotally connected to the support member, a truck in slidable engagement with the support member and the frame, an actuating member on which a push plate is located, the actuating member being pivotally connected to the support member and operatively connected to the truck, the actuating member being adapted to move between a first position and a second position, and a linking mechanism operatively connecting the actuating member the truck, wherein, when the user pushes the actuating member between the first position and the second position, the truck moves along rails on the support member, forcing the frame to pivot relative to the support member and causing the user to actuate a resistance weight, thus exercising certain of the user's muscles. This machine can be used in connection with a variety of different weight resistance mechanism, such as stack weights, free weights, and alternative weight resistance devices.

There are many other examples of leg exercise machines. U.S. Pat. No. 4,149,714 to Lambert, Jr. discloses a seated weight lifting leg press exercise machine having a moving push plate and a stationary seat. U.S. Pat. No. 4,828,254 to Maag discloses a crank and slider/four-bar variable resistance carriage-type leg press machine having a stationary push plate and a moving seat. U.S. Pat. No. 5,106,080 to Jones discloses a leg press exercise machine having a stationary seat and two moving push plates, one for each leg. U.S. Pat. No. 5,366,432 to Habing et al. discloses a leg press having a stationary seat and a moving push plate. U.S. Pat. No. 5,484,365 to Jones et al. discloses a leg press exercise machine having a stationary seat and a moving push plate. U.S. Pat. No. 5,554,086 to Habing et al. discloses a leg press exercise apparatus having a stationary push plate and a moving seat. U.S. Pat. No. 5,554,090 to Jones discloses a calf exercise machine having a stationary seat and a moving push plate. U.S. Pat. No. 5,616,107 to Simonson discloses a method and apparatus for leg press exercise with counterbalance having a stationary seat and a moving push plate. U.S. Pat. No. 5,795,270 to Woods et al. discloses a semi-recumbent arm and leg press and aerobic exercise apparatus having a stationary seat and a moving push plate.

There are many examples of chest exercise machines. U.S. Pat. No. 5,554,089 to Jones discloses a military press exercise machine having a stationary seat and moving actuating grips. U.S. Pat. No. 5,643,152 to Simonson discloses a chest press exercise machine and method of exercising having a stationary seat and moving actuator grips. U.S. Pat. No. 5,997,447 to Giannelli et al. discloses a chest press apparatus for exercising regions of the upper body having a stationary seat and moving actuator grips.

There are many examples of back exercise machines. U.S. Pat. No. 5,135,449 to Jones discloses a rowing exercise machine having a stationary seat and moving actuating grips. U.S. Pat. No. 5,620,402 to Simonson discloses a rear deltoid and rowing exercise machine and method of exercising having a stationary seat and moving actuator grips.

There are other machines for exercising other parts of the torso, such as the abdominal muscles, or combinations of muscles. U.S. Pat. No. 5,125,881 to Jones discloses a rear shoulder exercise machine having a stationary bench and moving actuating pads. U.S. Pat. No. 5,554,084 to Jones discloses an abdominal/hip flex exercise machine having a stationary seat and moving actuator pads. U.S. Pat. No. 6,010,437 to Jones discloses a standing push/pull exercise machine having no user support and moving actuator grips.

The previously described art comprises a general cross-section of the exercise and physical therapy equipment and machine art as it is today. As can be seen, individual apparatuses either use weight plates, weight stacks, free weights, user body weight, tensile resistance, or air resistance, or a combination of weight stacks or free weights with the user's body weight. Thus it can be seen that a moment arm weight resistance mechanism and a weight training machine comprising a moment arm weight resistance mechanism would be useful, novel and not obvious, and a significant improvement over the prior art. Such a mechanism can be used as the basic operative mechanism on a wide variety of weight training equipment and machines. It is to such a moment arm weight resistance mechanism and weight training equipment and machines that the current invention is directed.

BRIEF SUMMARY OF THE INVENTION

Briefly, the invention is a moment arm weight resistance mechanism to generate weight resistance for weight training equipment and machines. A first embodiment of the invention comprises a cam, a moment arm, an actuating means, an adjustable weight, a weight adjusting drive, a pivot point about which the moment arm pivots, and a weight adjusting motor for moving the weight along the moment arm. A second embodiment of the invention comprises a moment arm, an actuating means, an adjustable weight, a weight adjusting drive, a pivot point about which the moment arm pivots, and a weight adjusting motor for moving the weight along the moment arm. A third embodiment of the invention comprises a linkage, such as a pivoting bar linkage, a moment arm, an actuating means, an adjustable weight, a weight adjusting drive, a pivot point about which the moment arm pivots, and a weight adjusting motor for moving the weight along the moment arm. A fourth embodiment of the invention comprises a moment arm, an actuating means, a direct connection between the moment arm and an actuating means, an adjustable weight, a weight adjusting drive, a pivot point about which the moment arm pivots, and a weight adjusting motor for moving the weight along the moment arm. The moment arm is pivotally secured about the pivot point, about which the moment is created, and extends generally normal to the pivot axis of the pivot point. Thus, the moment arm acts as a cantilever extending from the pivot point, and the moment arm can rotate about the pivot axis of the pivot point. The moment creates a weight resistance that can be utilized in weight training machines as an alternative.

In one embodiment of the moment arm, the moment arm is a generally hollow, elongated, box-like structure containing the weight and the weight adjusting drive. The weight adjusting motor also can be within the moment arm, but also can be located outside of the box-like structure with the weight adjusting drive extending from the weight adjusting motor through a hole in an end of, and into the interior of, the box-like structure of the moment arm. In another embodiment of the moment arm, the moment arm is a generally solid, elongated structure supporting the weight and the weight adjusting drive. The weight adjusting motor also can be supported on, by or proximal to the solid structure. The moment arm can be secured to the moment arm pivot rod by any known or suitable means. The pivot rod is an attachment means for pivotally and operatively attaching the moment arm to a weight training machine. The weight adjusting drive cooperates with the weight such that when the weight adjusting drive is activated, the weight will move relatively along the weight adjusting drive and the moment arm, thus adjusting the level of weight resistance.

The moment arm weight resistance mechanism can be pivotally attached to the weight training machine such that when activated, the moment arm can pivot or swing upwards and downwards without any or undue hindrance by any components of the weight training machine. The pivot rod can be pivotally mounted on the frame of the weight training machine. A cable or other linkage can be attached to an actuating device, such as a hand grip or leg pad, and can travel through or about the frame via pulleys, ultimately to the moment arm weight resistance mechanism. The user sits or stands on, or otherwise operates, the weight training machine in the known manner, with the user's hand or legs contacting the actuating means. When the user actuates the actuating device or means, such as by pulling down on a hand grip or bar, by moving a hand bar or leg bar, or by using his or her legs to move a leg pad, the cable is pulled or the linkage is acted on. By moving the actuating device or means, the user causes the upward and downward pivoting of the moment arm, and obtains a weight resistance workout.

In a first embodiment of the invention, the cable cooperates with the cam proximal to the pivot point of the moment arm, and when the cable is pulled, the pulling has the ultimate result of pulling upwards on the cam, thus rotating the cam. As the cam is attached to the moment arm, the moment arm also is rotated upwards, causing the moment about the pivot point and the weight resistance against the cable. In a second embodiment of the invention, the cable cooperates with an attachment means distal from the pivot point of the moment arm, and when the cable is pulled, the pulling has the ultimate result of pulling upwards on the moment arm on an end of the moment arm opposite the pivot point. As the cable is attached to the moment arm, the moment arm is rotated upwards, causing the moment about the pivot point and the weight resistance against the cable. In a third embodiment of the invention, the bar linkage cooperates with the moment arm proximal to the pivot point of the moment arm, and when the bar linkage is acted on, as the bar linkage is attached to the moment arm, the moment arm also is rotated upwards, causing the moment about the pivot point and the weight resistance against the bar linkage. In a fourth embodiment of the invention, the actuating means is directly connected to the moment arm in a lever-type manner, such that when the actuating means is moved, due to the direct connection to the moment arm, the moment arm also moves.

The degree of weight resistance of the weight resistance mechanism can be controlled by the user. As the adjustable weight is adjusted along the moment arm relative to a pivot point of the moment arm, the weight resistance of the moment arm is increased or decreased.

These features, and other features and advantages of the present invention will become more apparent to those of ordinary skill in the art when the following detailed description of the preferred embodiments is read in conjunction with the appended figures in which like reference numerals designate like elements throughout the several views.

DETAILED DESCRIPTION OF THE PREFERRED EMBODIMENTS

Referring now to the appended figures, the invention will be described in connection with representative preferred embodiments. Throughout this specification, various terms will be used to describe various elements or sets of elements, features or sets of features, and devices or sets of devices. For example, the term weight training machine will be used to describe any weight training machine in which a user pulls, pushes, squeezes, twists, or otherwise moves or manipulates an actuating means or device to activate weight resistance. The term actuating means or actuating device will be used to describe any bar, handle, pad, or other element that is operatively connected to the moment arm weight resistance mechanism. The term at rest and resting mode will be used to describe when the user is not engaging the moment arm weight resistance mechanism, or only minimally so. The term operating and operating mode will be used to describe when the user is engaging the moment arm weight resistance mechanism. The term pull, when referring to the user operating the actuating means or device, will be used to describe any motion or movement by a user on the actuating means or device to activate weight resistance, including but not limited to pulling, pushing, squeezing, twisting, and rotating.

Figure 1:
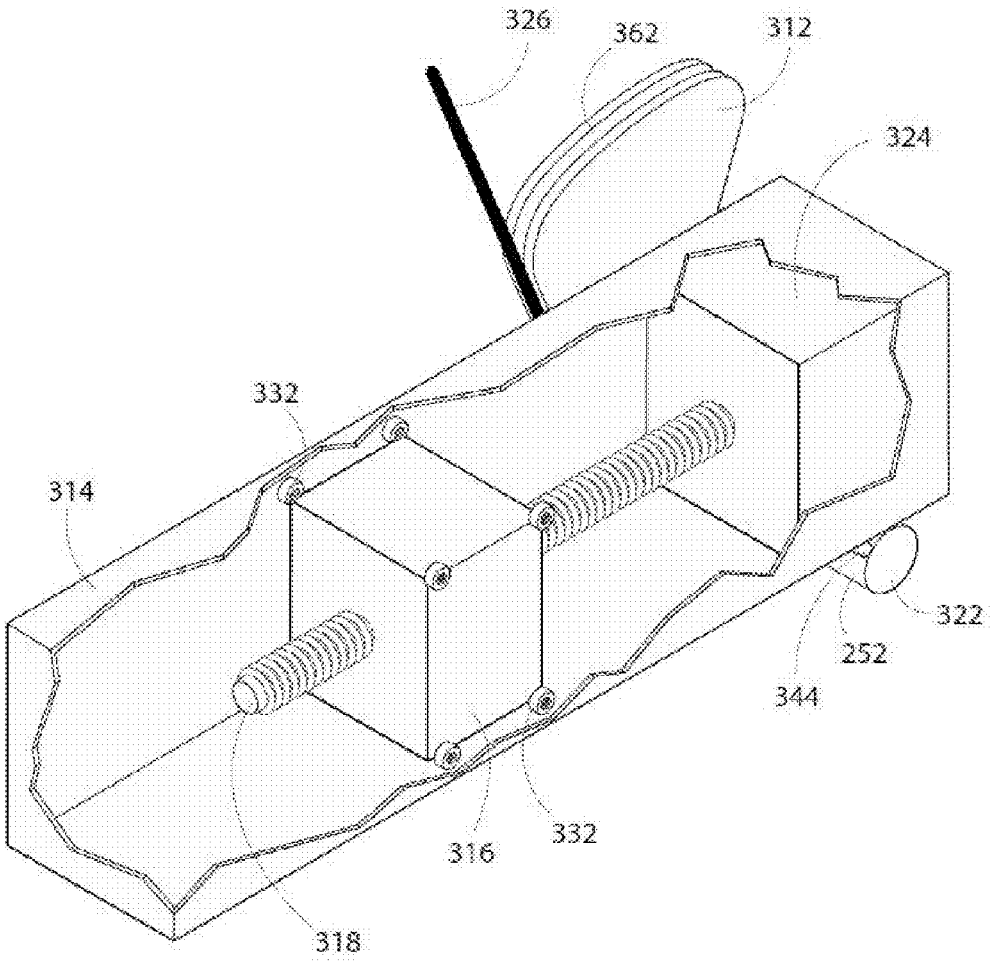
FIG. 1 is a sectional perspective view of an embodiment of the moment arm weight resistance mechanism of the invention.
Figure 2:
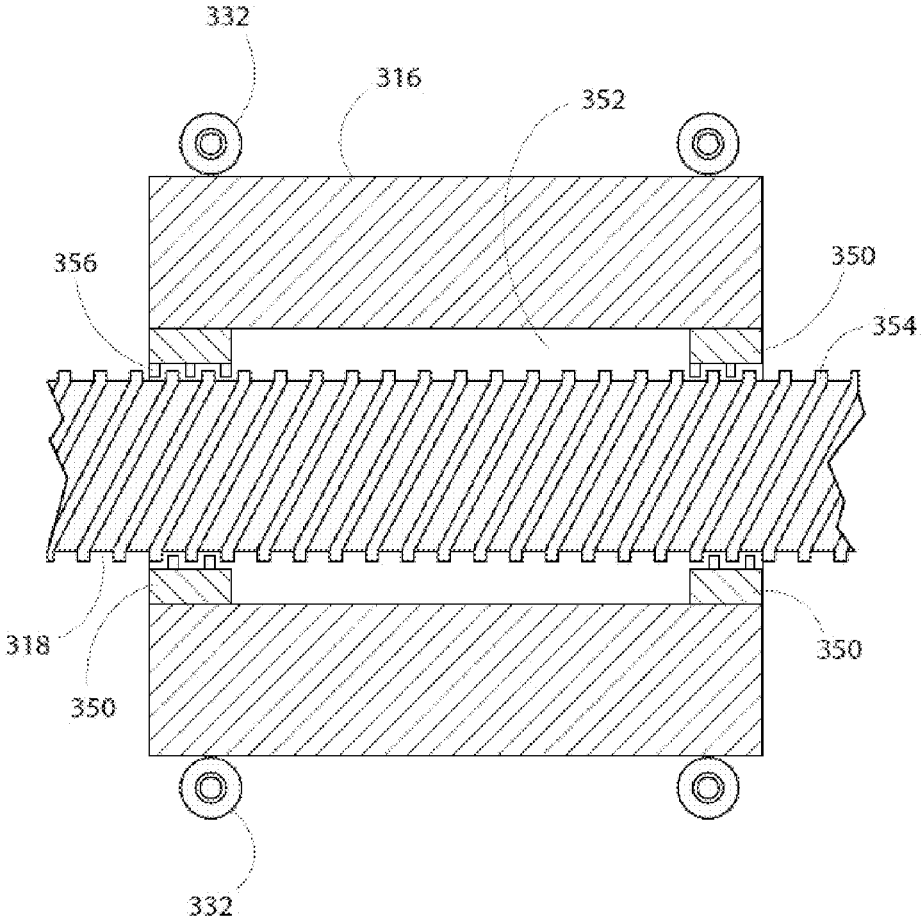
FIG. 2 is a sectional side view of a weight and weight adjusting drive that can be used with the invention.

FIG. 1 is a sectional perspective view of an embodiment of the moment arm weight resistance mechanism of the invention showing basic working elements of the invention in a closed box configuration. FIG. 2 is a sectional side view of a weight and weight adjusting drive that can be used with the invention, corresponding with the weight and weight adjusting drive shown in FIG. 1.

Figure 3:
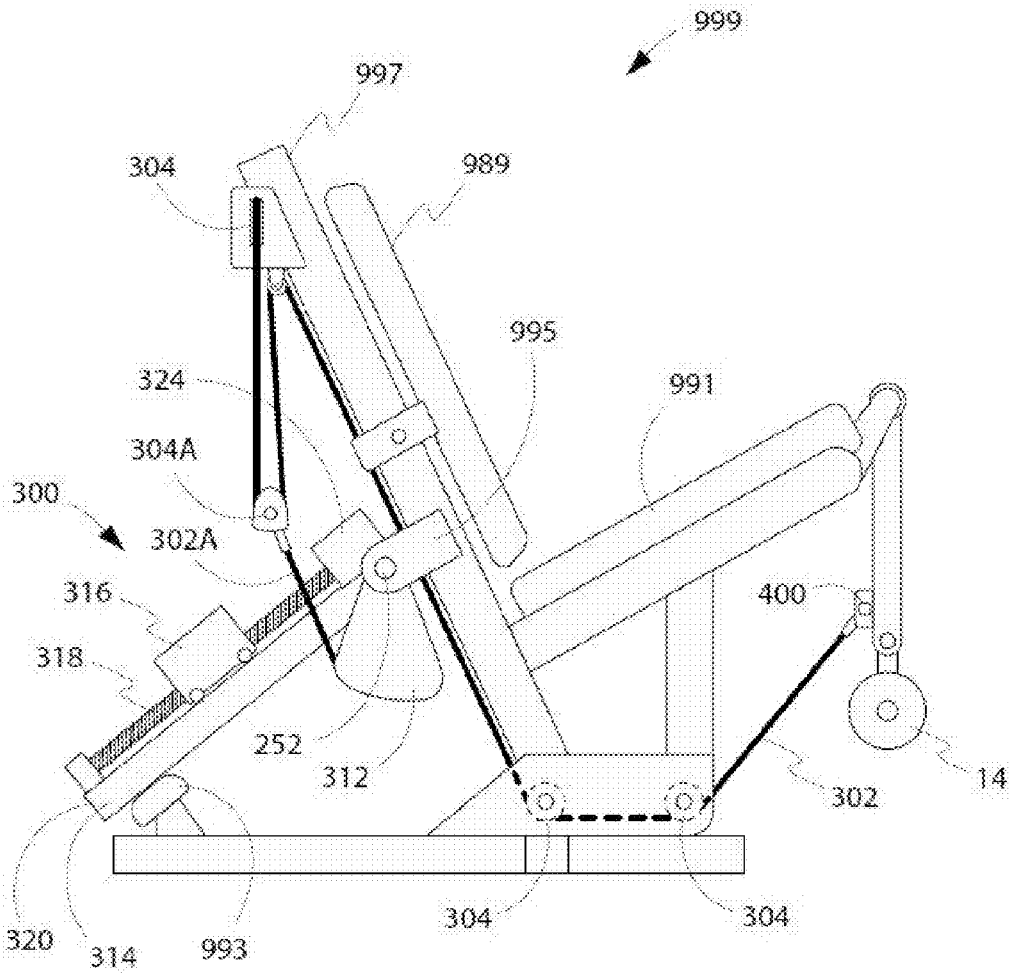
FIG. 3 is a side view of a single function weight training machine comprising an embodiment of the moment arm weight resistance mechanism of the present invention in the resting mode.
Figure 4:
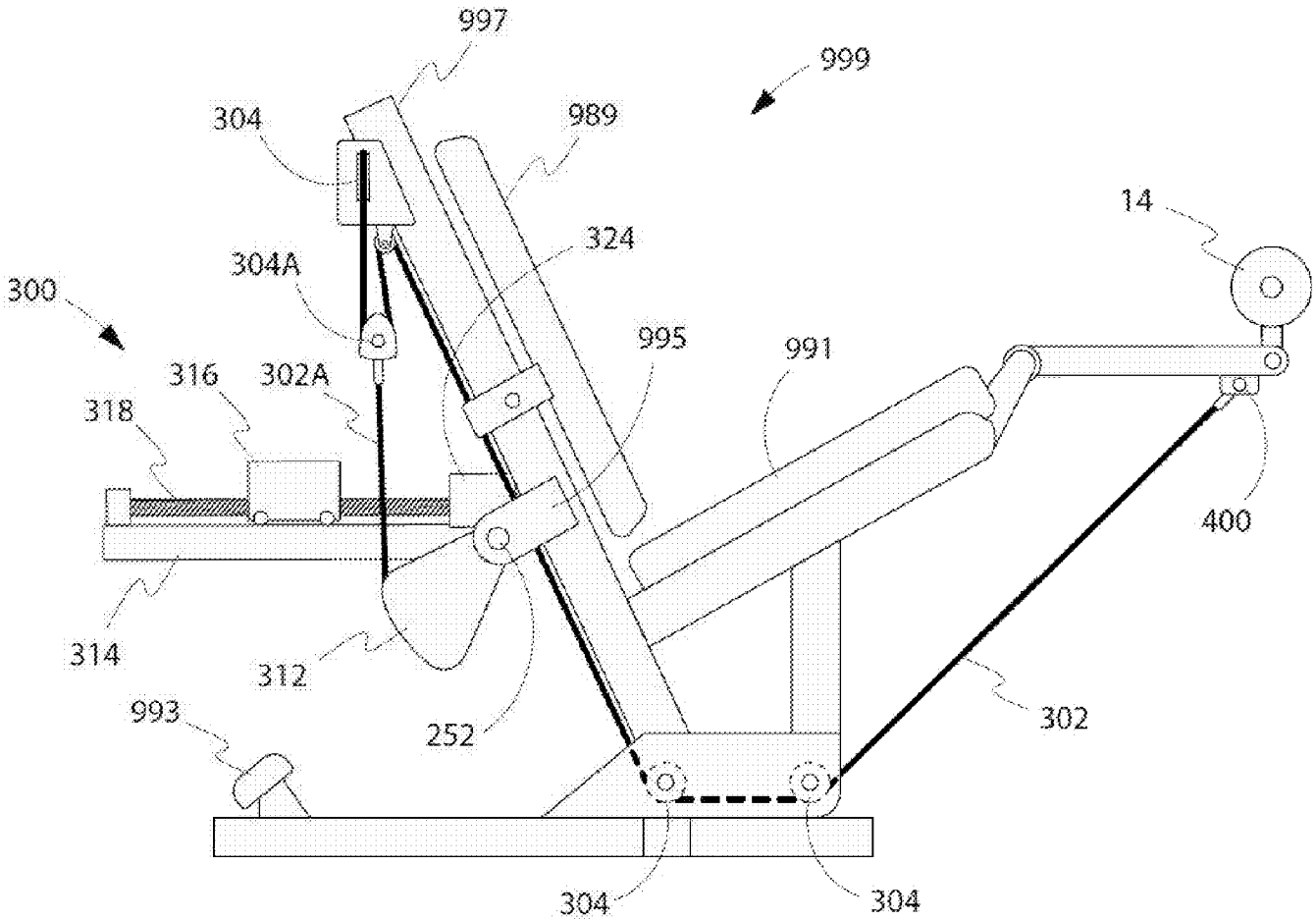
FIG. 4 is a side view of the weight training machine shown in FIG. 3 comprising an embodiment of the moment arm weight resistance mechanism of the present invention in the operating mode.
Figure 5:
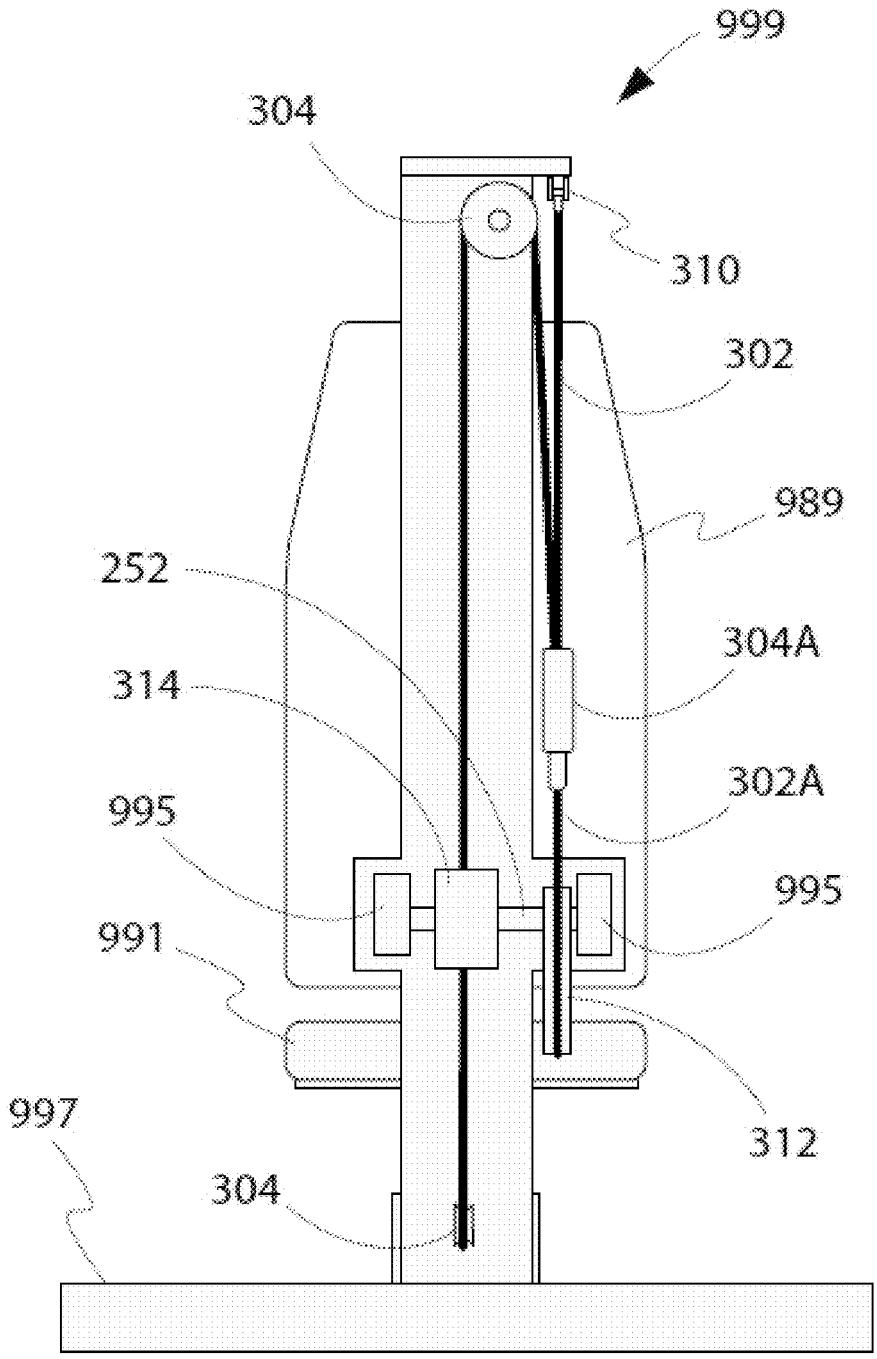
FIG. 5 is a rear view of the weight training machine shown in FIG. 3 comprising an embodiment of the moment arm weight resistance mechanism of the present invention.

FIG. 3 is a side view of a first representative weight training machine comprising an embodiment of the moment arm weight resistance mechanism of the present invention in the resting mode, that is, with the user at rest. This weight training machine is a leg extension quadriceps machine. FIG. 4 is a side view of the weight training machine shown in FIG. 3 comprising an embodiment of the moment arm weight resistance mechanism of the present invention in the operating mode, that is, with the user lifting weight. FIG. 5 is a rear view of the weight training machine shown in FIG. 3 comprising an embodiment of the moment arm weight resistance mechanism of the present invention.

Figure 6:
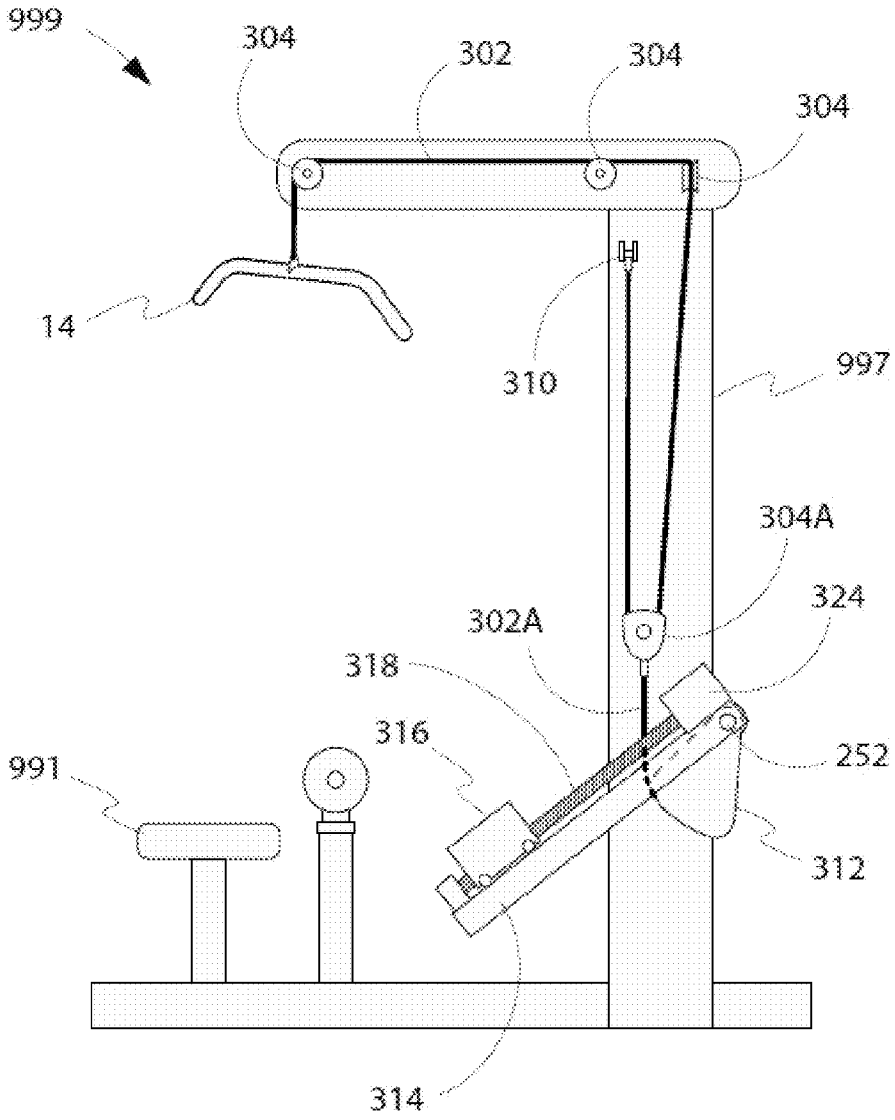
FIG. 6 is a side view of a single function weight training machine comprising an embodiment of the moment arm weight resistance mechanism of the present invention in the resting mode.
Figure 7:
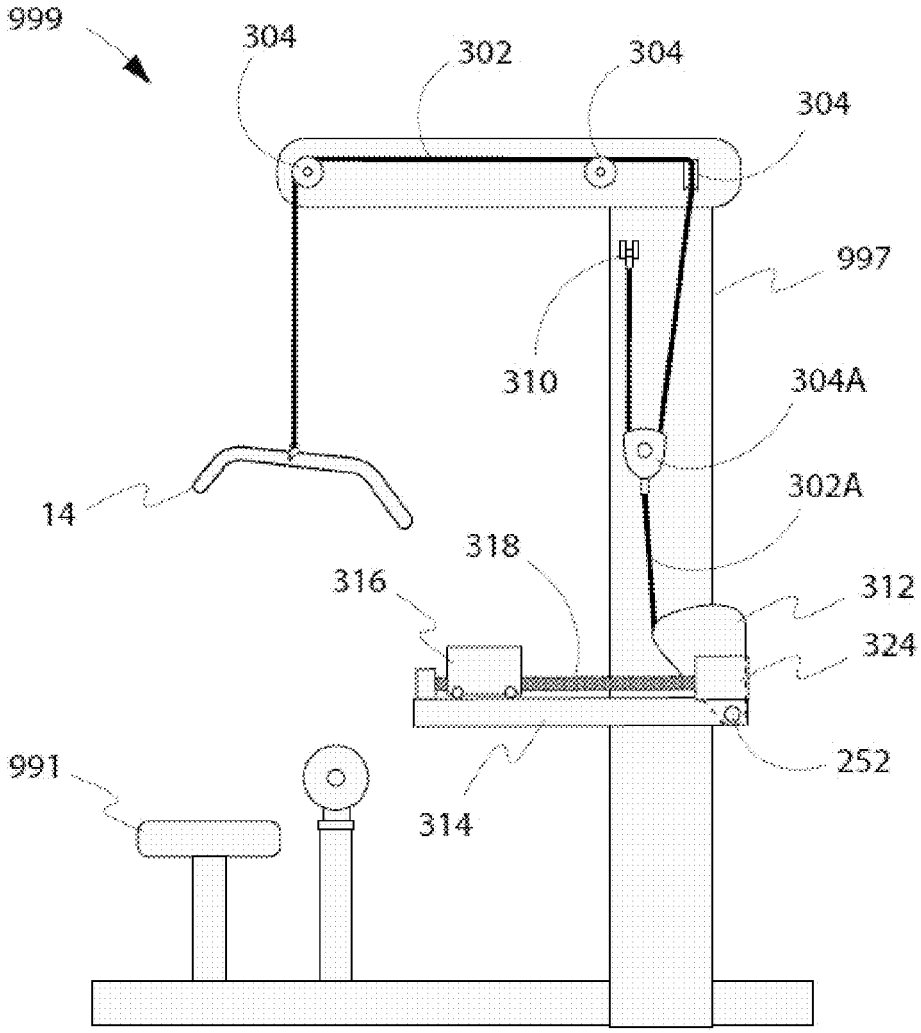
FIG. 7 is a side view of a weight training machine shown in FIG. 6 comprising an embodiment of the moment arm weight resistance mechanism of the present invention in the operating mode.

FIG. 6 is a side view of a second representative weight training machine comprising an embodiment of the moment arm weight resistance mechanism of the present invention in the resting mode, that is, with the user at rest. This machine is a latissimus dorsi pull-down machine. FIG. 7 is a side view of the weight training machine shown in FIG. 6 comprising an embodiment of the moment arm weight resistance mechanism of the present invention in the operating mode, that is, with the user lifting weight.

Figure 8:
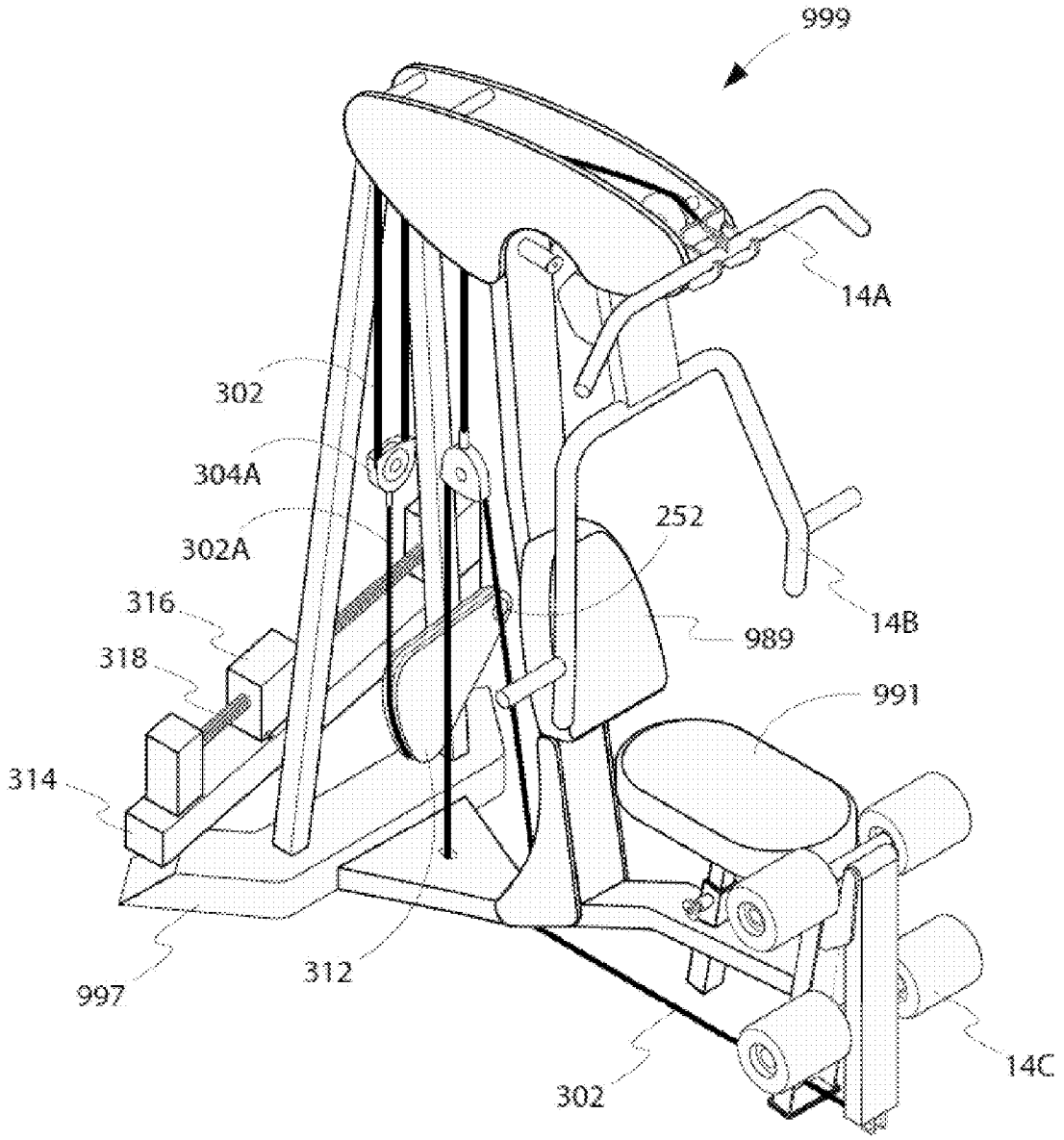
FIG. 8 is a perspective view of a multi-function weight training machine comprising an embodiment of the moment arm weight resistance mechanism of the present invention in the resting mode.
Figure 9:
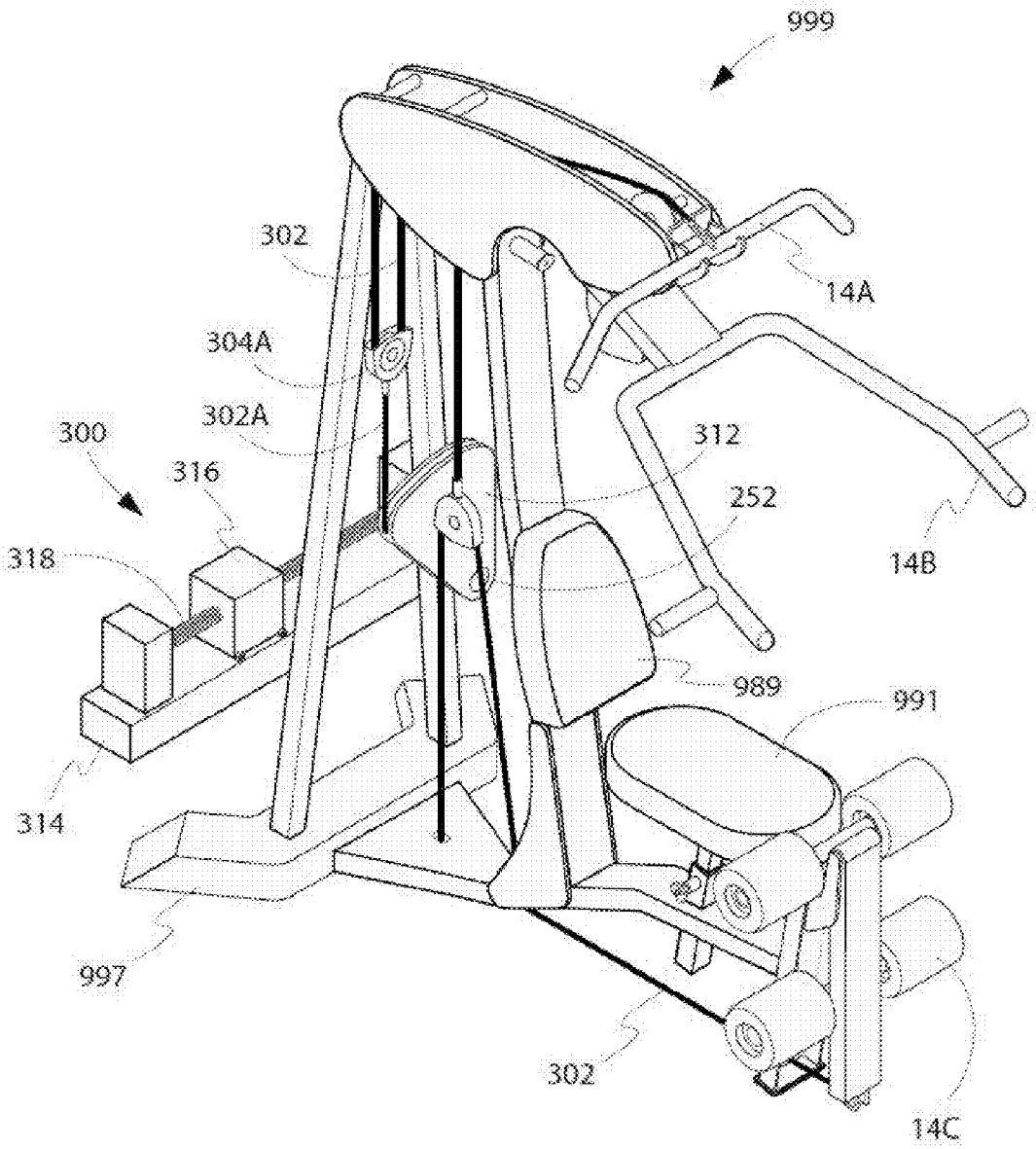
FIG. 9 is a perspective view of the weight training machine shown in FIG. 8 comprising an embodiment of the moment arm weight resistance mechanism of the present invention in the operating mode.
Figure 10:
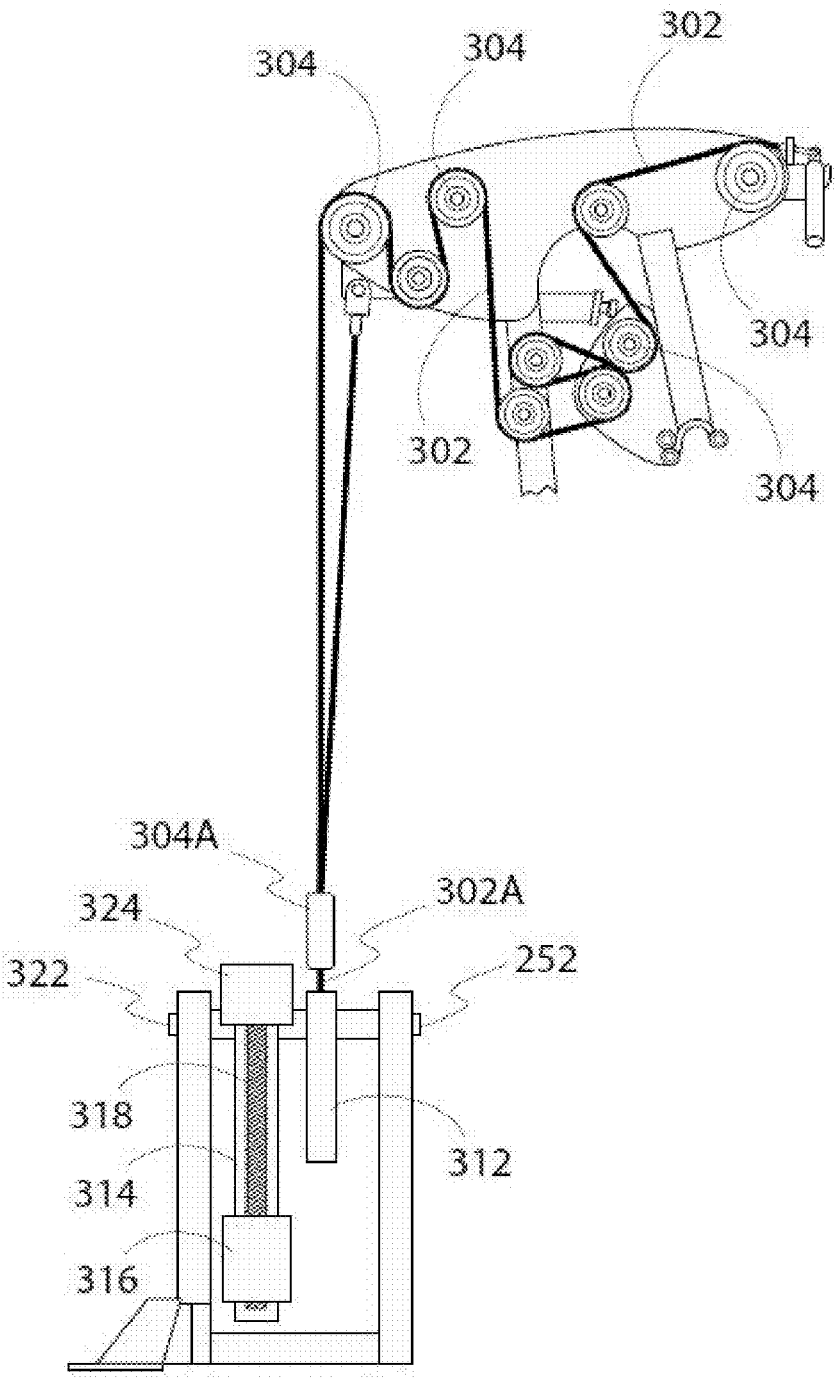
FIG. 10 is a side view of an embodiment of a cable and pulley configuration for a weight training machine comprising an embodiment of the moment arm weight resistance mechanism of the present invention.

FIG. 8 is a perspective view of a third representative weight training machine comprising an embodiment of the moment arm weight resistance mechanism of the present invention in the resting mode, that is, with the user at rest. This weight training machine is a multi-station or multi-function combination weight training machine for exercising all major muscle groups. FIG. 9 is a perspective view of the weight training machine shown in FIG. 8 comprising an embodiment of the moment arm weight resistance mechanism of the present invention in the operating mode, that is with the user lifting weight. FIG. 10 is a side view of an embodiment of a cable and pulley configuration for a combination weight training machine comprising an embodiment of the moment arm weight resistance mechanism of the present invention.

Figure 11:
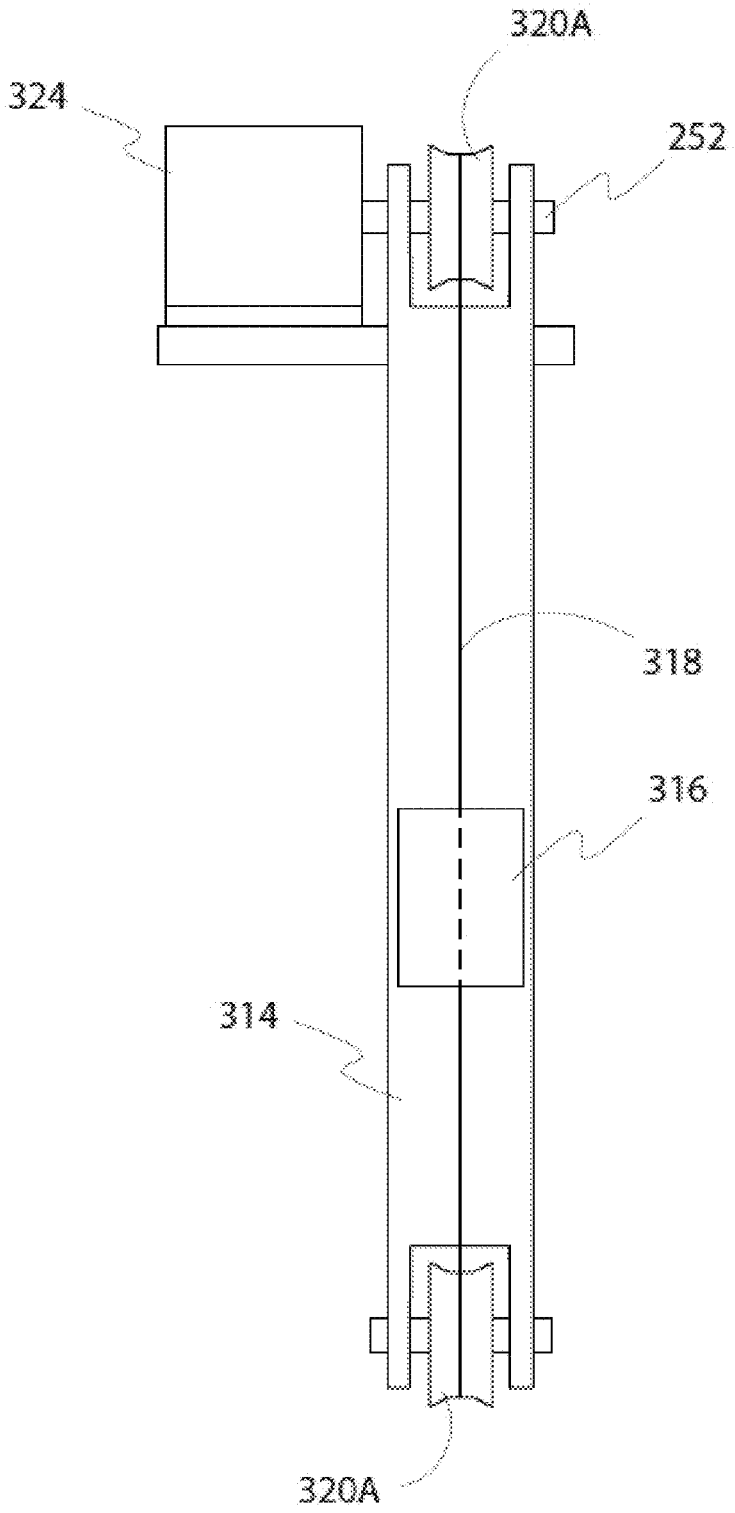
FIG. 11 is a top view of an alternate embodiment of the moment arm weight resistance mechanism of the invention.
Figure 12:
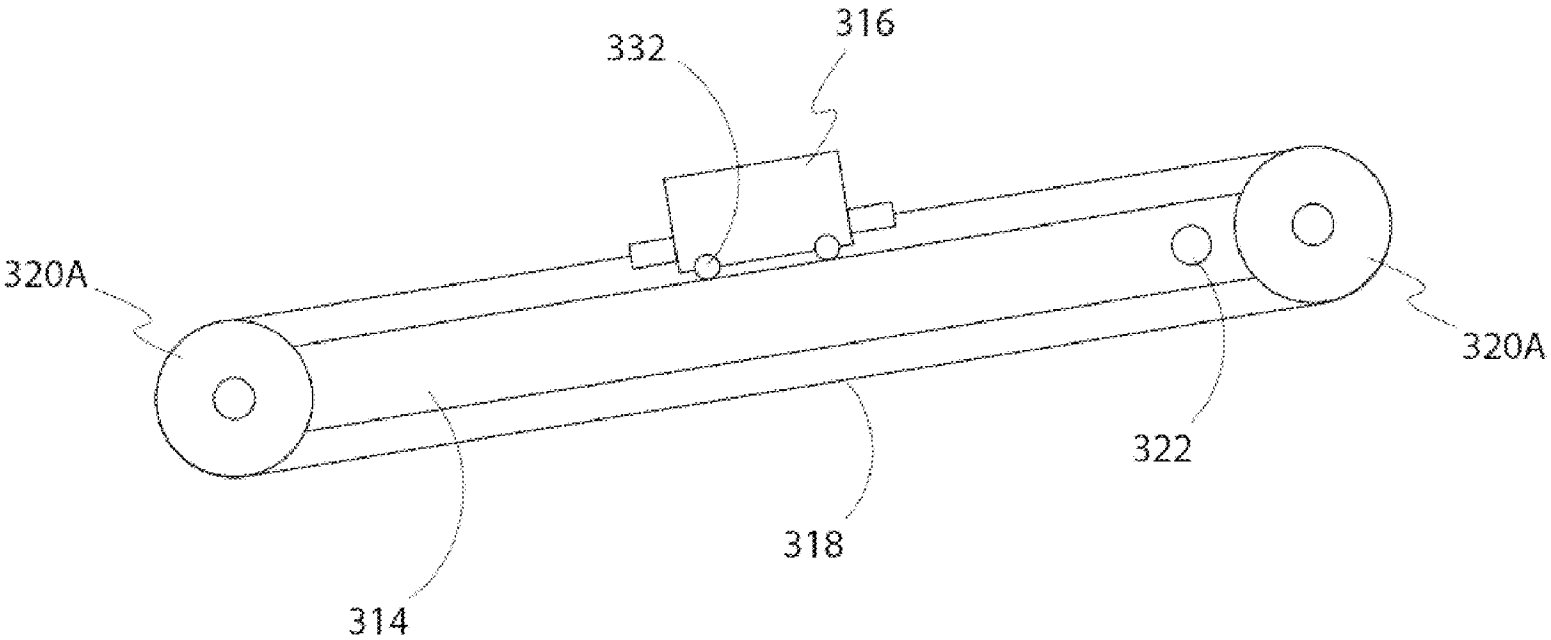
FIG. 12 is a side view of the alternate embodiment of the moment arm weight resistance mechanism shown in FIG. 11.
Figure 13:
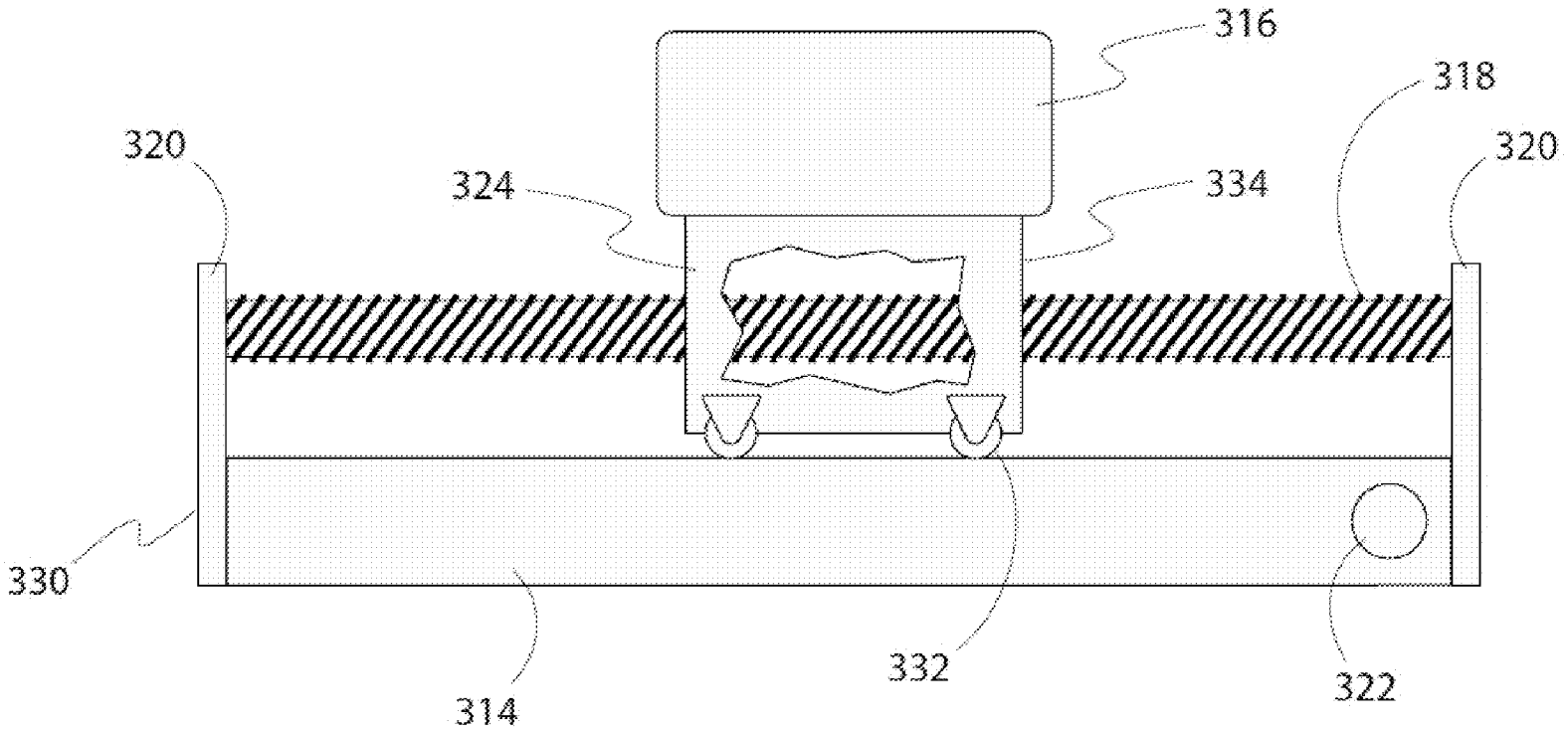
FIG. 13 is a side view of another alternate embodiment of the moment arm weight resistance mechanism of the invention.

FIG. 11 is a top view of an alternate embodiment of the moment arm weight resistance mechanism of the invention. FIG. 12 is a side view of the alternate embodiment of the moment arm weight resistance mechanism shown in FIG. 11. FIG. 13 is a side view of another alternate embodiment of the moment arm weight resistance mechanism of the invention.

Figure 14:
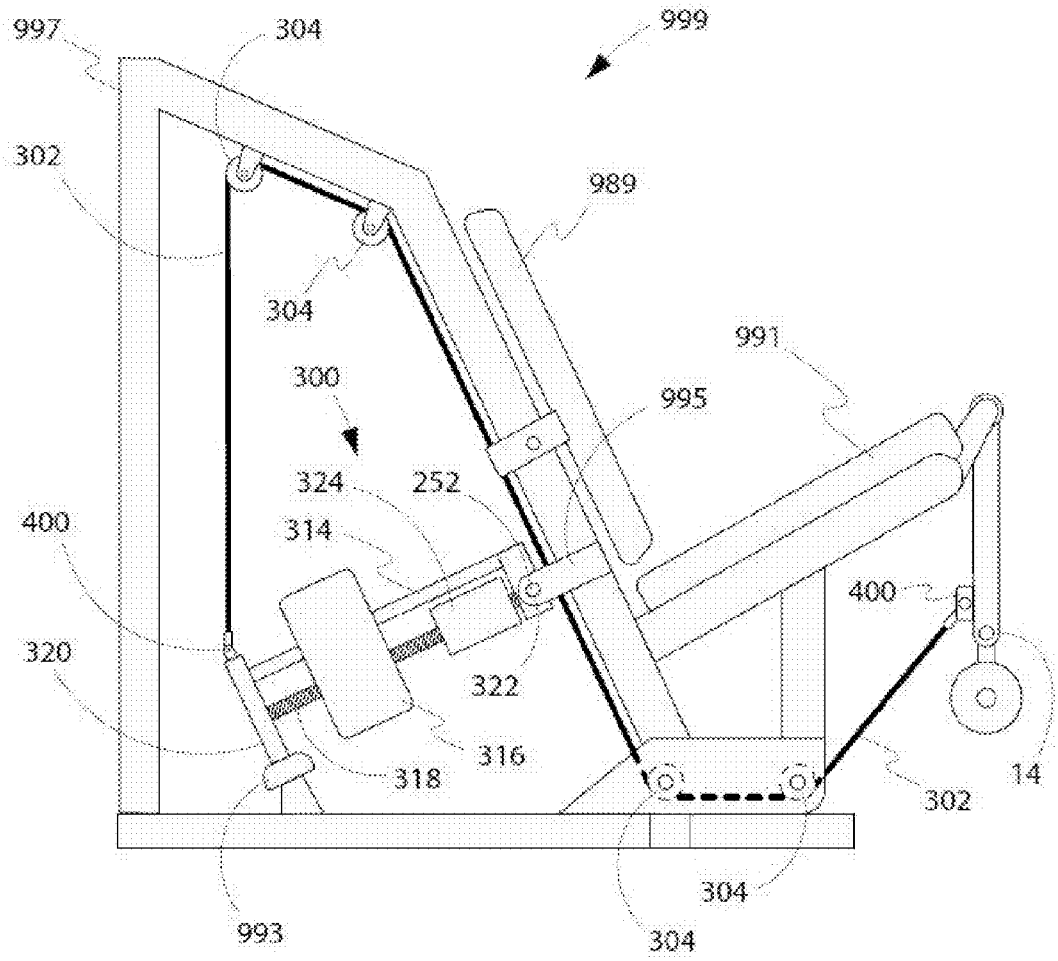
FIG. 14 is a side view of another weight training machine comprising an embodiment of the moment arm weight resistance mechanism of the present invention in the resting mode.
Figure 15:
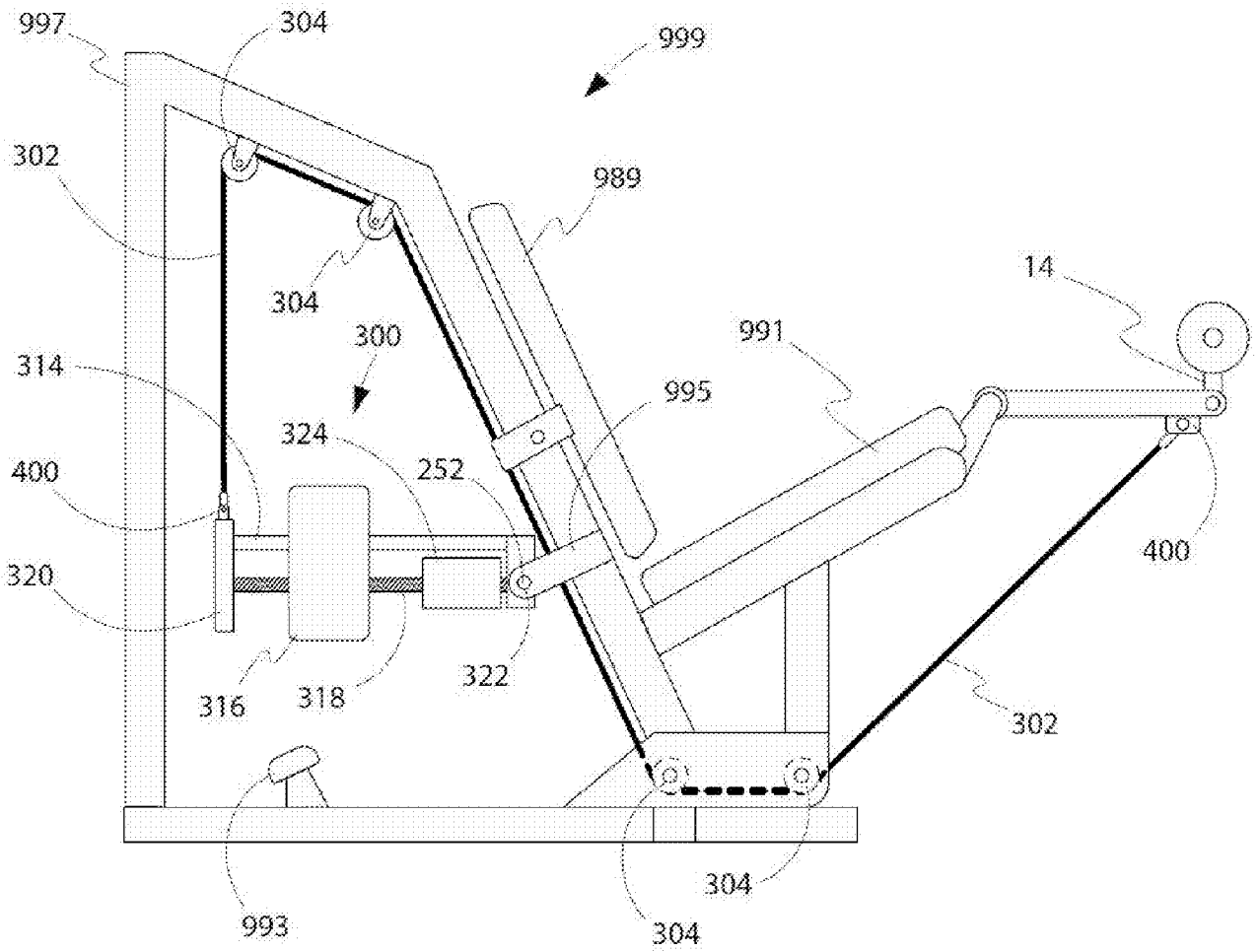
FIG. 15 is a side view of the weight training machine shown in FIG. 14 comprising an embodiment of the moment arm weight resistance mechanism of the present invention in the operating mode.

FIG. 14 is a side view of a fourth representative embodiment of a weight training machine comprising an embodiment of the moment arm weight resistance mechanism of the present invention in the resting mode, that is, with the user at rest. This machine is a leg extension machine without a cam. FIG. 15 is a side view of the weight training machine shown in FIG. 14 comprising an embodiment of the moment arm weight resistance mechanism of the present invention in the operating mode, that is, with the user lifting weight.

Figure 16:
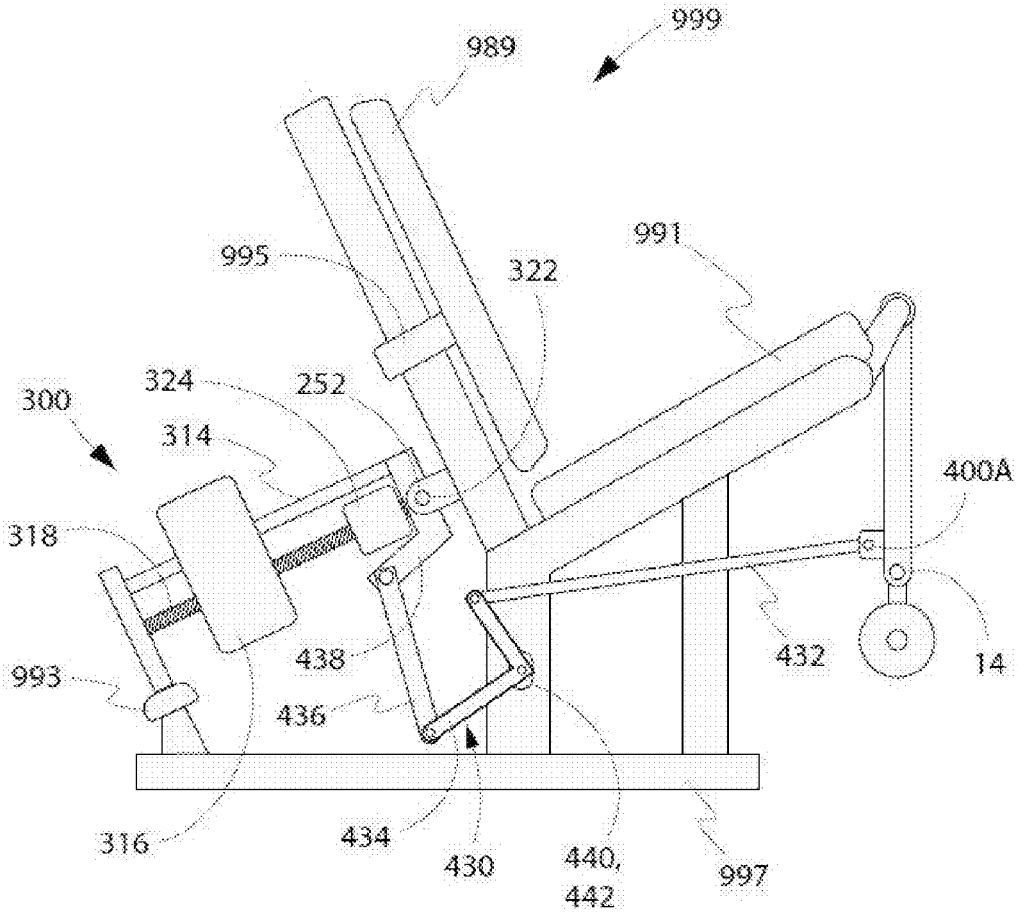
FIG. 16 is a side view of another weight training machine comprising an embodiment of the moment arm weight resistance mechanism of the present invention in the resting mode.
Figure 17:
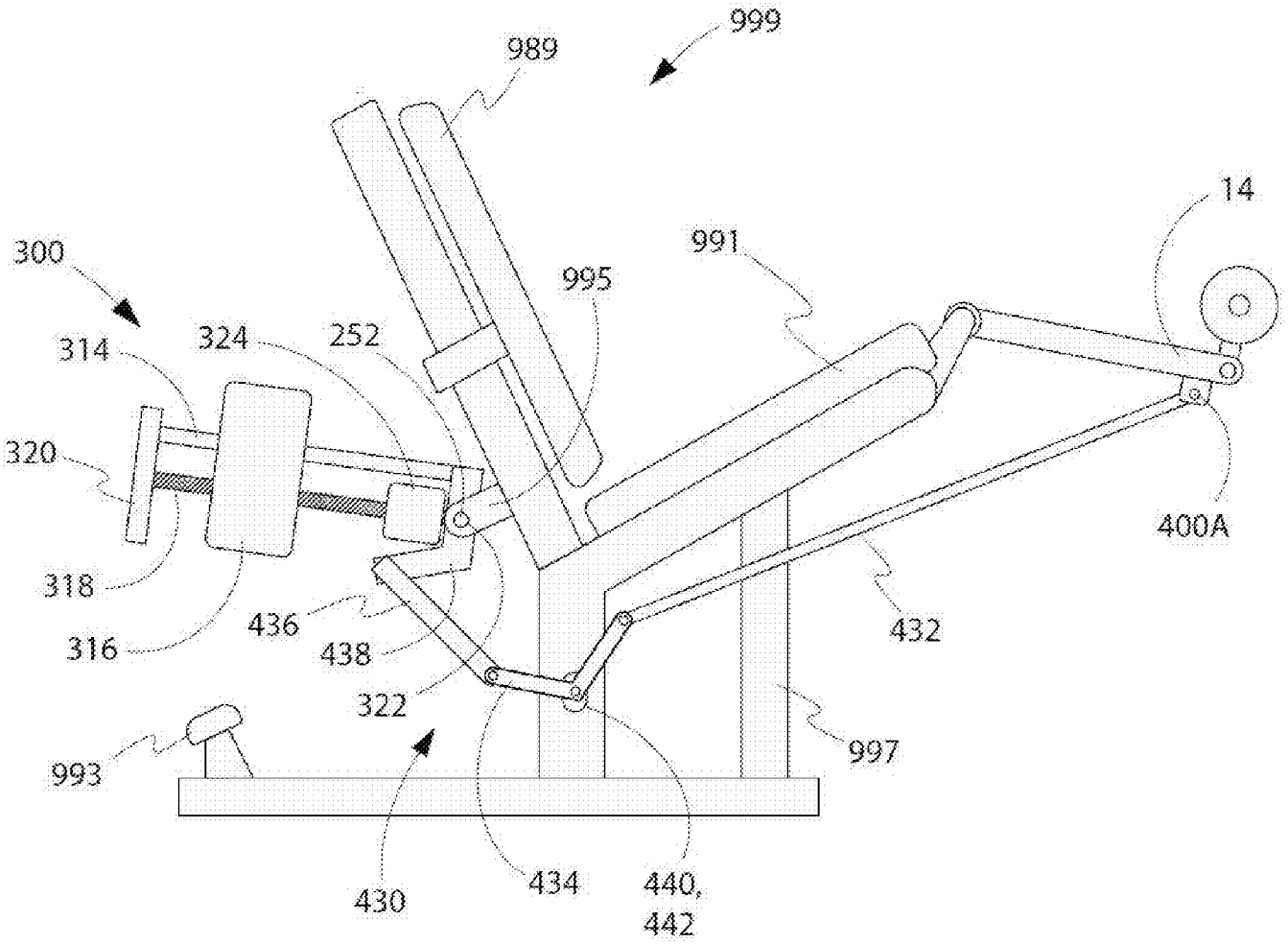
FIG. 17 is a side view of the weight training machine shown in FIG. 16 comprising an embodiment of the moment arm weight resistance mechanism of the present invention in the operating mode.

FIG. 16 is a side view of a fifth representative embodiment of a weight training machine comprising an embodiment of the moment arm weight resistance mechanism of the present invention in the resting mode, that is, with the user at rest. This machine is a leg extension machine with a bar linkage. FIG. 17 is a side view of the weight training machine shown in FIG. 16 comprising an embodiment of the moment arm weight resistance mechanism of the present invention in the operating mode, that is, with the user lifting weight.

Figure 18:
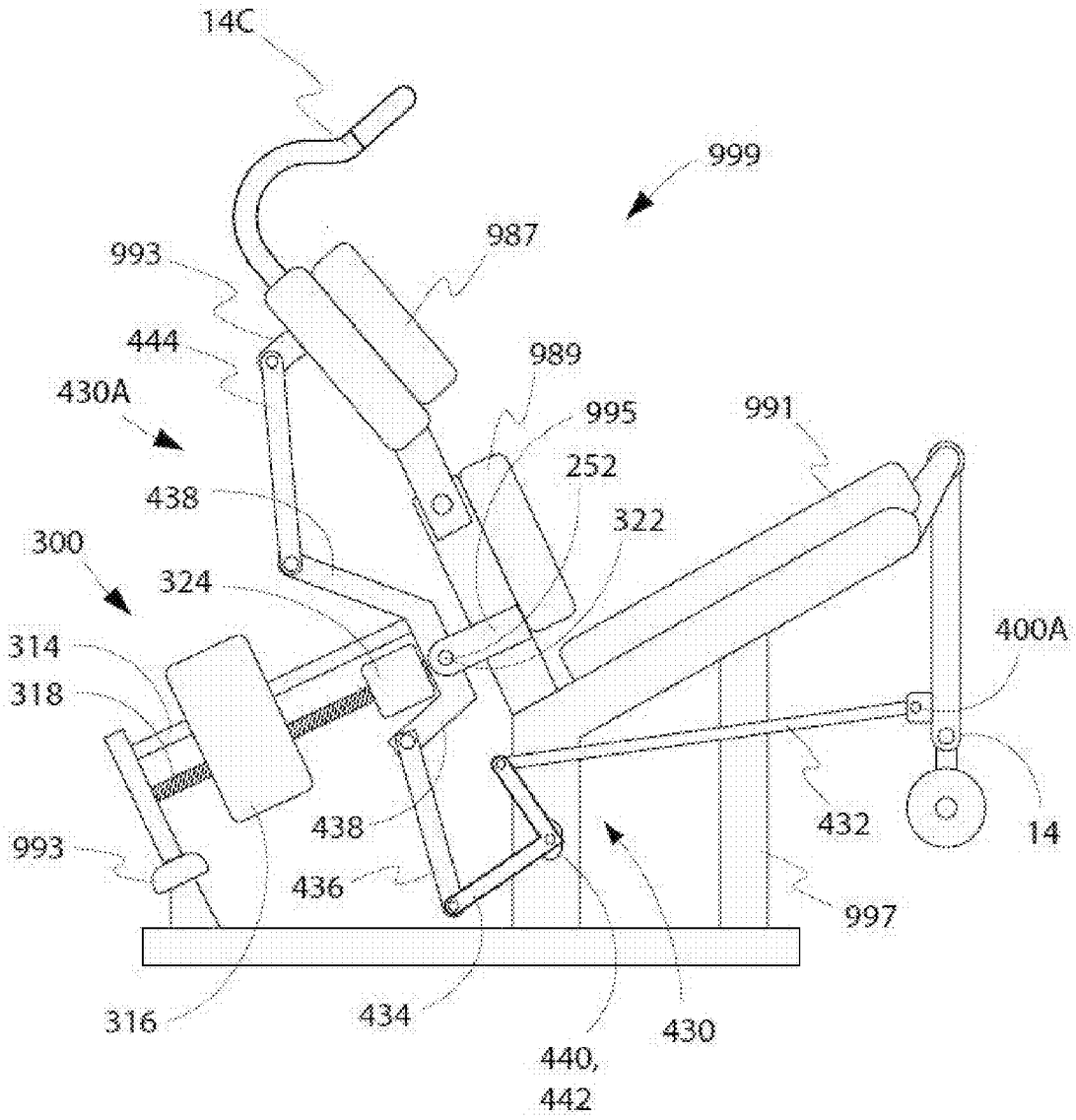
FIG. 18 is a side view of another weight training machine comprising an embodiment of the moment arm weight resistance mechanism of the present invention in the resting mode.
Figure 19:
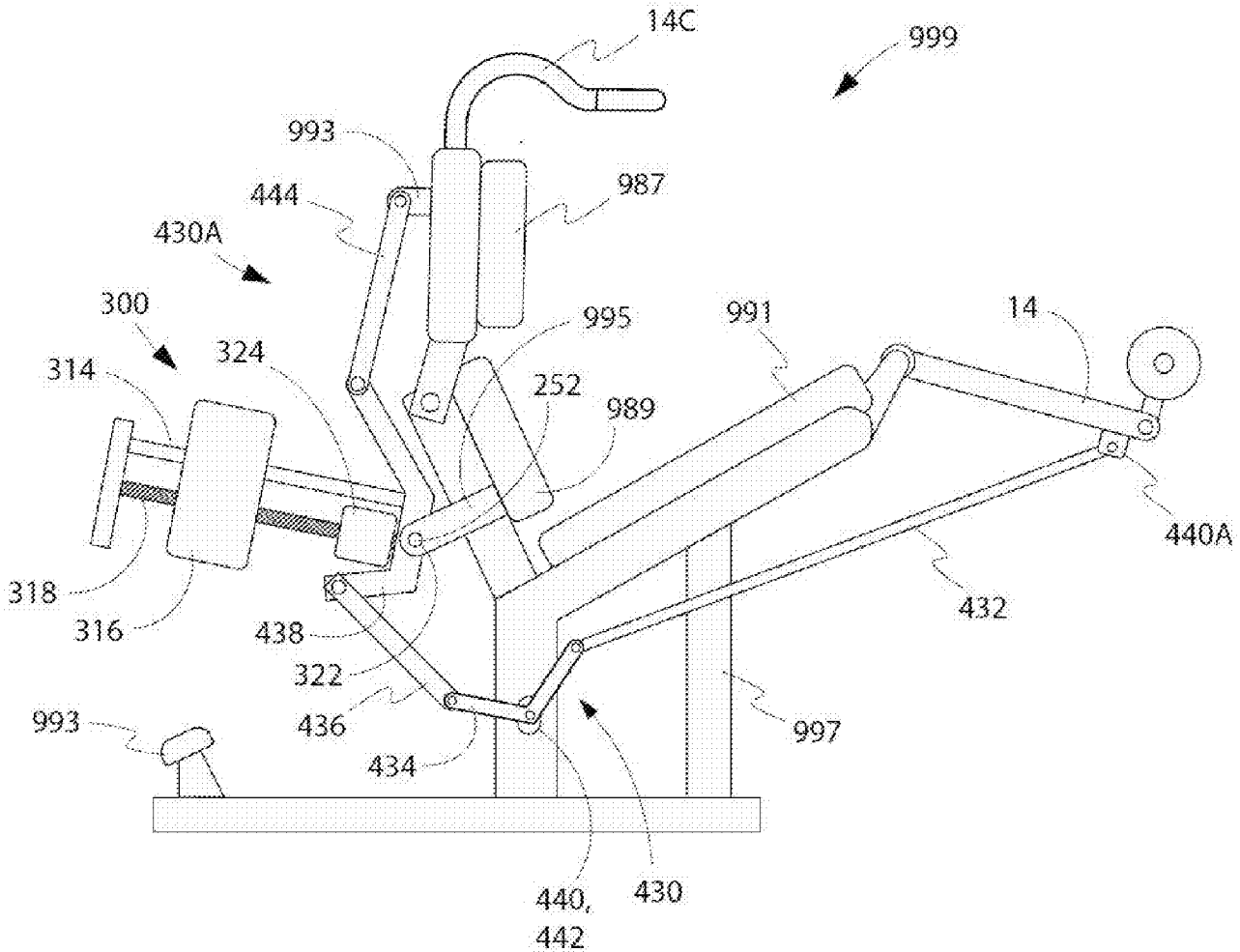
FIG. 19 is a side view of the weight training machine shown in FIG. 18 comprising an embodiment of the moment arm weight resistance mechanism of the present invention in the operating mode.

FIG. 18 is a side view of a sixth representative embodiment of a weight training machine comprising an embodiment of the moment arm weight resistance mechanism of the present invention in the resting mode, that is, with the user at rest. This machine is a combination leg extension and torso rotational crunch machine with a bar linkage. FIG. 19 is a side view of the weight training machine shown in FIG. 18 comprising an embodiment of the moment arm weight resistance mechanism of the present invention in the operating mode, that is, with the user lifting a weight.

Figure 20:
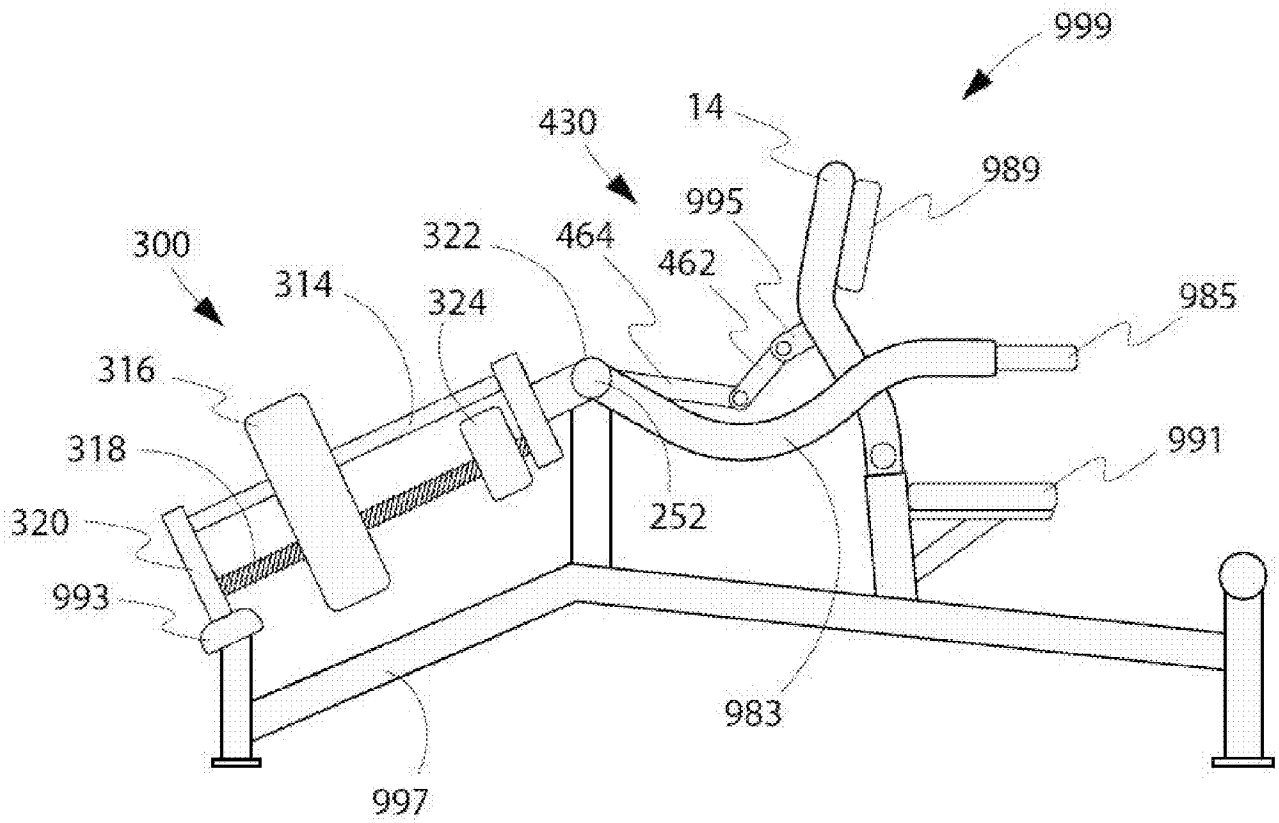
FIG. 20 is a side view of another weight training machine comprising additional embodiments of the moment arm weight resistance mechanism of the present invention in the resting mode.
Figure 21:
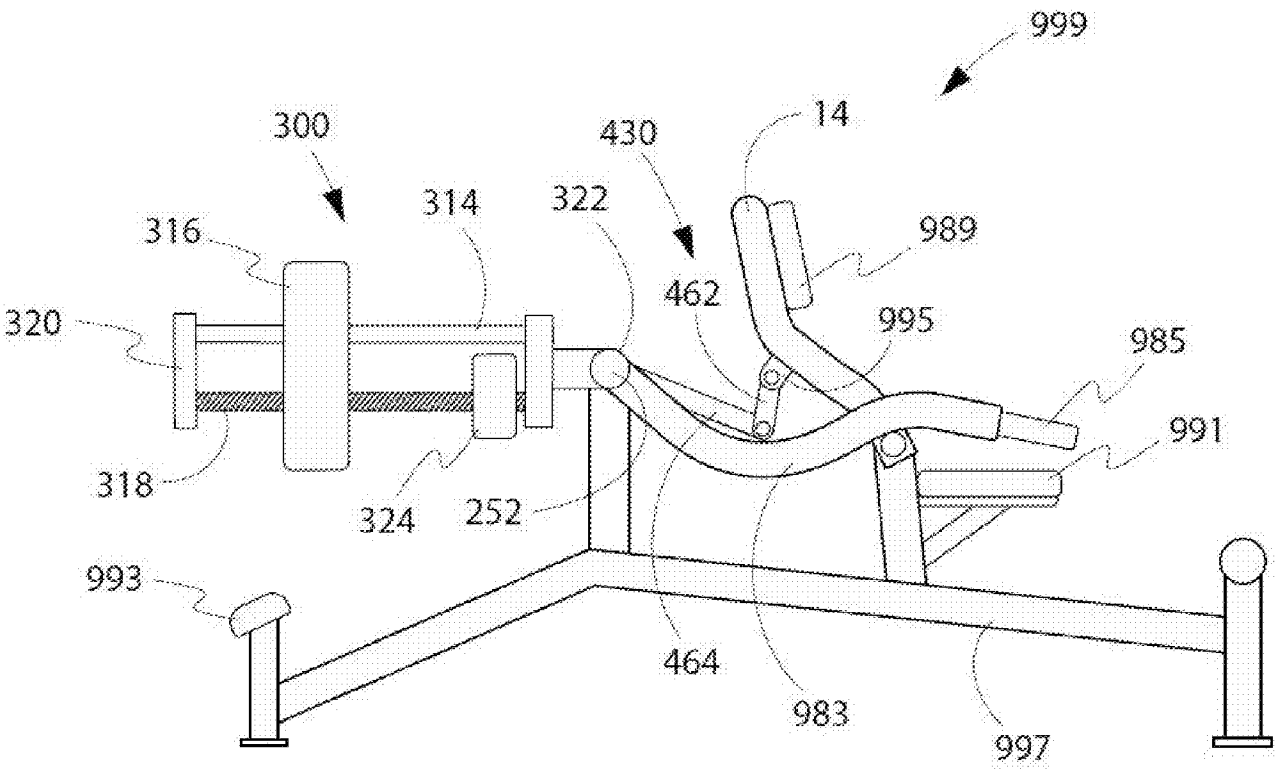
FIG. 21 is a side view of the weight training machine shown in FIG. 20 comprising additional embodiments of the moment arm weight resistance mechanism of the present invention in the operating mode.

FIG. 20 is a side view of a seventh representative embodiment of a weight training machine comprising additional embodiments of the moment arm weight resistance mechanism of the present invention in the resting mode, that is, with the user at rest. This machine is a combination lower back and triceps press machine with a bar linkage. FIG. 21 is a side view of the weight training machine shown in FIG. 20 comprising additional embodiments of the moment arm weight resistance mechanism of the present invention in the operating mode, that is, with the user lifting weight.

Figure 22:
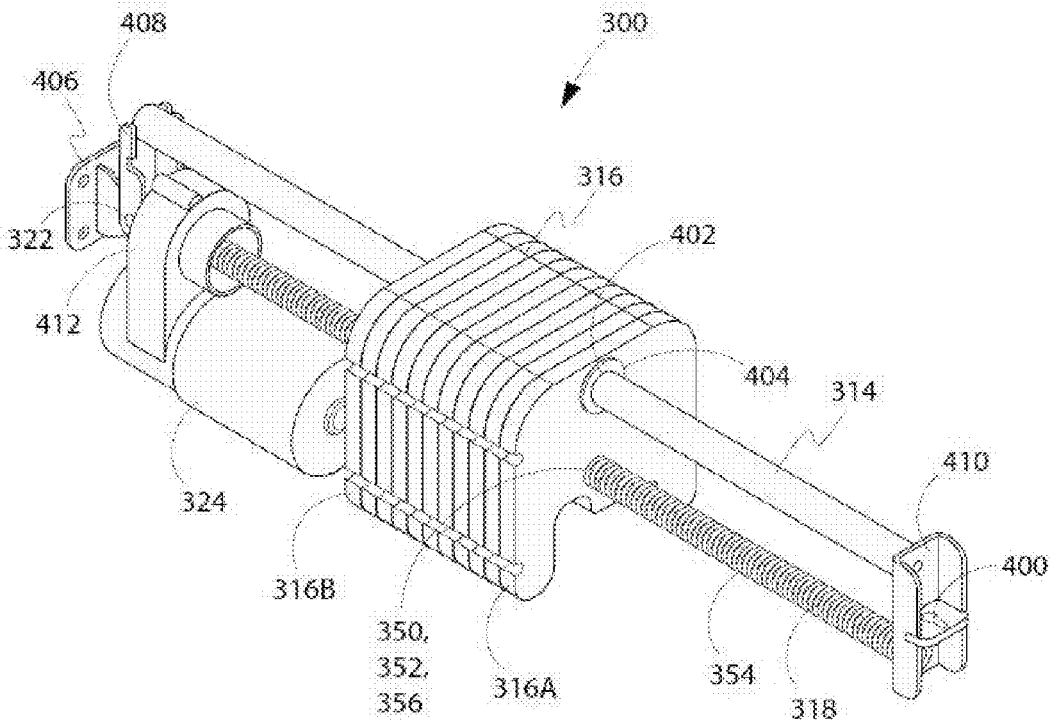
FIG. 22 is a first perspective view of an alternate embodiment of the moment arm weight resistance mechanism of the invention.
Figure 23:
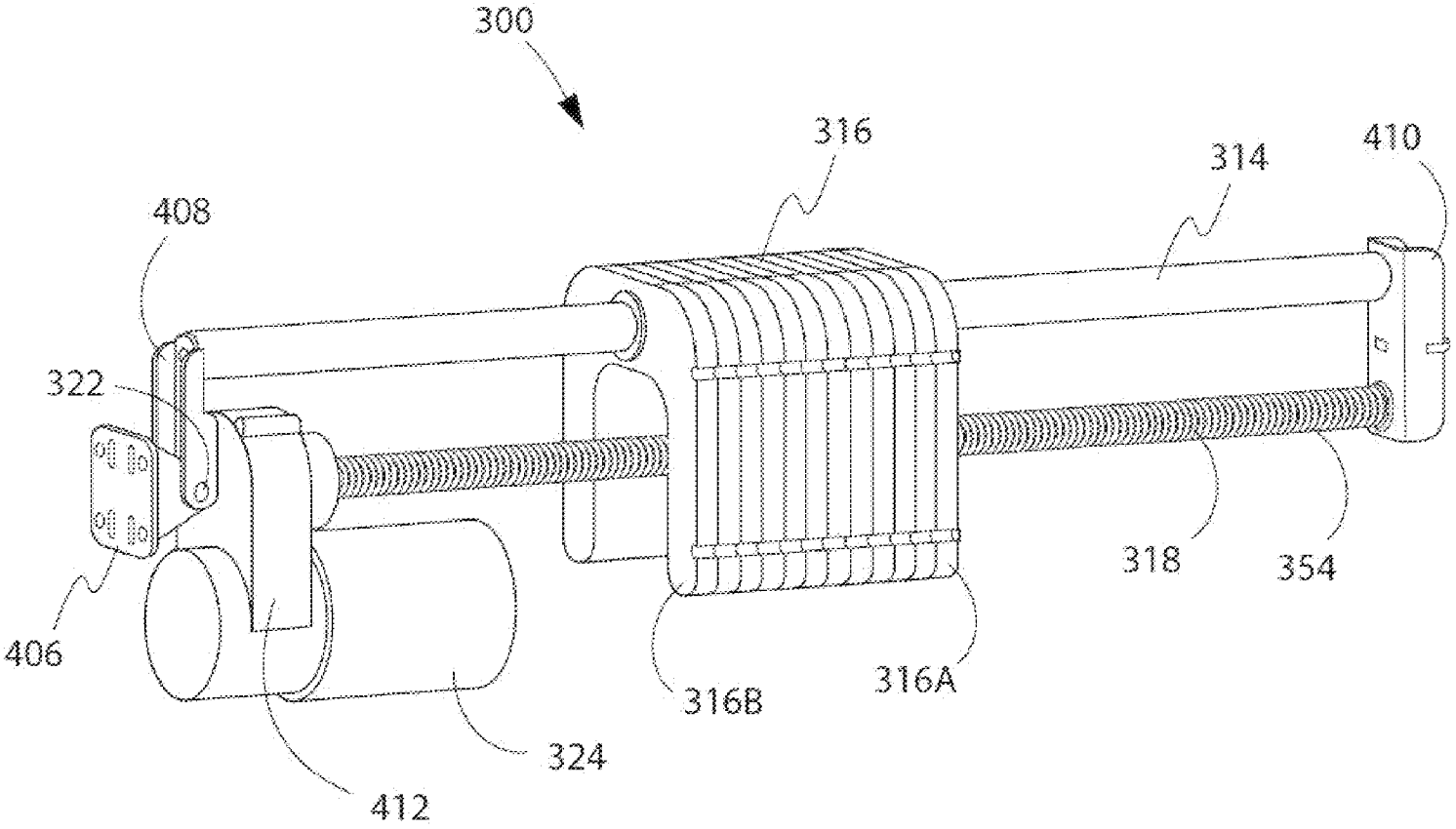
FIG. 23 is a second perspective view of the alternate embodiment of the moment arm weight resistance mechanism shown in FIG. 22.

FIG. 22 is a first perspective view of an alternate embodiment of the moment arm weight resistance mechanism of the invention. FIG. 23 is a second perspective view of the alternate embodiment of the moment arm weight resistance mechanism shown in FIG. 22. FIGS. 22 and 23 illustrate a generally solid, elongated structure supporting the weight and the weight adjusting drive.

FIG. 1 is a sectional perspective view of a representative embodiment of the moment arm weight resistance mechanism 300 showing basic working elements of the invention. This embodiment of moment arm weight resistance mechanism 300 comprises cam 312, moment arm 314, weight 316, weight adjusting drive 318, pivot point 322, and weight adjusting motor 324. Moment arm 314 is pivotally secured about pivot point 322, about which the moment is created, and extends generally normal to the pivot axis of pivot point 322. Thus, moment arm 314 acts as a cantilever extending from pivot point 322, and moment arm 314 can rotate about the pivot axis of pivot point 322. In this embodiment, moment arm 314 is a generally box-like structure in which weight 316 can roll and can be termed a closed arm embodiment.

FIG. 1 also illustrates that, in this embodiment, moment arm 314 is a generally hollow, elongated, box-like structure containing weight 316 and weight adjusting drive 318. Weight adjusting motor 324 also is shown within moment arm 314, but can be located outside of the box-like structure with weight adjusting drive 318 extending from weight adjusting motor 324 through a hole in an end of, and into the interior of, the box-like structure of moment arm 314. Moment arm 314 is illustratively shown as being welded onto moment arm pivot rod 252 by weldments 344, but moment arm 314 can be secured to moment arm pivot rod 252 by any known or suitable means. Pivot rod 252 is an attachment means for pivotally attaching moment arm 314 to a weight training machine 999. Weight 316 in this example comprises wheels 332 on both its top and bottom surfaces, which can provide for smoother and quieter rolling and less friction between weight 316 and the interior surfaces of moment arm 314. Alternatively, weight 316 can be provided with other devices and means for reducing friction, for quieting operation, and for increasing ease of movement.

FIG. 1 also illustrates an embodiment of cam 312. Generally, cam 312 is secured to moment arm 314 coaxially with the pivot axis of pivot point 322, and the rotation of cam 312 caused by the pulling of cam cable 326, as disclosed in more detail below, causes moment arm 314 to rotate about pivot point 322. The side of cam 312 that cooperates with cam cable 326 can have a groove 362 into which cam cable 326 can lie. Such a groove 362 can help direct and secure cam cable 326 during operation and can help prevent cam cable 326 from slipping off of cam 312.

FIG. 2 is a sectional side view of a weight 316 and weight adjusting drive 318 that can be used with the present invention. Weight 316 comprises an internal passage 352 extending therethrough from one side to an opposite side. In this embodiment, internal passage 352 is a smooth bore with no screw thread. The diameter of internal passage 352 is greater than the outer diameter of the screw thread 354 of weight adjusting drive 318 such that weight adjusting drive 318 can slide into and through internal passage 352. One or more threaded nuts 350 are inserted into internal passage 352 and secured by known means, such as, but not limited to, friction, adhesives, welding, soldering, clips, a flange that is part of the nut 350 itself and screwed into the weight 316, and the like.

Weight adjusting drive 318, and particularly the screw thread 354 of weight adjusting drive 318 cooperates with the screw thread 356 of nut 350 such that when weight adjusting drive 318 is rotated, as disclosed herein, weight 316 will move relatively along weight adjusting drive 318.

FIGS. 3, 6 and 9 are views of representative weight training machines 999 focusing in on the operative relationship between the actuating means 14 and the moment arm 314 in what is termed the resting mode. In this mode, the actuating means 14 is in a resting position such that no or a minimal amount of weight or force is being transferred from moment arm 314 and weight 316 to main cable 302 to actuating means 14. Although FIGS. 3, 6, and 9 show an open arm embodiment, this is for illustrative purposes only and to show the relative placement of the various elements of the invention.

FIGS. 4, 7, and 10 are views focusing in on the operative relationship between the actuating means 14 and the moment arm 314 in what is termed the operating mode. In this mode, the actuating means 14 is being moved in an operating manner by a user, thus pulling on the main cable 302. Main cable 302 is pulled through pulleys 304 so as to direct or redirect main cable 302 from actuating means 14 ultimately to moment arm weight resistance mechanism 300. As main cable 302 is pulled, this operates to rotate cam 312. Cam 312 is secured to pivot rod 252 coaxially with the pivot axis of pivot point 322, and the rotation of cam 312 caused by the pulling of main cable 302 or cam cable 326 causes moment arm 314, which also is secured to pivot rod 252, to rotate about pivot point 322. The rotation of moment arm 314 by the rotation of cam 312 causes moment arm 314 to rotate upwards into the operating position. Release of the actuating means 14, has the opposite rotational effect.

In FIGS. 3-9, the configuration of main cable 302 and pulleys 304 from actuating means 14 just prior to weight resistance mechanism 300 can be identical or similar to the configuration of cable and pulleys in known weight training machines, and the specific configuration of main cable 302 and pulleys 304 can be determined by those of ordinary skill in the art without undue experimentation for each type of weight training machine 999, such as those shown in FIGS. 6 and 9.

FIG. 3 is a side view of a first representative weight training machine 999 comprising an embodiment of the moment arm weight resistance mechanism 300 of the present invention in the resting mode, that is, with the user at rest. This weight training machine 999 is a leg extension quadriceps machine. Moment arm weight resistance mechanism 300 is pivotally attached to the back side of weight training machine 999 such that when activated, moment arm 314 can pivot or swing upwards and downwards without any or undue hindrance by any components of weight training machine 999. Pivot rod 252 is pivotally mounted on the frame 997 of weight training machine 999, such as on brackets 995. Brackets 995 can have bearings (not shown) to reduce friction and/or to better hold pivot rod 252. Stop 993 provides a place for moment arm 314 to rest or sit when not in use, and prevents moment arm 314 from traveling downward more than a suitable distance.

FIG. 3 illustrates an exemplary configuration of main cable 302 and pulleys 304 operatively connecting actuating device 14 to moment arm weight resistance mechanism 300. Main cable 302 attaches to actuating device 14, such as by bracket 993, and travels through or about frame 997 via pulleys 304, ultimately to moment arm weight resistance mechanism 300. Main cable 302 can travel through frame 997 for aesthetic and safety purposes. In the embodiment shown, pulley 304A is a class 2 movable pulley attached to a cam cable 302A, which is attached to cam 312. In this weight training machine 999, the moment arm weight resistance mechanism 300 is shown mounted pointed rearward.

FIG. 4 is a side view of the weight training machine 999 shown in FIG. 3 comprising an embodiment of the moment arm weight resistance mechanism 300 of the present invention in the operating mode, that is, with the user lifting weight. The user (not shown) sits on the seat 991 of weight training machine 999 in the known manner, with the user's legs contacting the actuating means 14. Weight training machine 999 also has a backrest 989. When the user actuates (moves, such as by lifting his or her lower legs so as to pivot) the actuating means 14 upwards, main cable 302 is pulled with the ultimate result of pulling upwards on cam 312, thus rotating cam 312. As cam 312 is attached to moment arm 314, moment arm 314 also is rotated upwards, causing the moment about pivot point 322 and weight resistance against cable 302. By lifting and lowering actuating means 14, the user causes the upward and downward rotation of moment arm 314, and obtains a weight resistance workout.

FIG. 5 is a rear view of the weight training machine 999 shown in FIG. 3 comprising an embodiment of the moment arm weight resistance mechanism 300 of the present invention. This view better illustrates the structural relationship between moment arm 314, cam 312, pivot rod 252, and brackets 995. As this embodiment uses a class 2 movable pulley 304A, main cable 302 is anchored to frame 997 via anchor 310.

FIG. 6 is a side view of a second representative weight training machine 999 comprising an embodiment of the moment arm weight resistance mechanism 300 of the present invention in the resting mode, that is, with the user at rest. This weight training machine 999 is a latissimus dorsi pull-down machine. Similar to as disclosed in connection with FIG. 3, moment arm weight resistance mechanism 300 is pivotally attached to weight training machine 999 such that when activated, moment arm 314 can pivot or swing upwards and downwards without any or undue hindrance by any components of weight training machine 999. Pivot rod 252 is pivotally mounted on the frame 997 of weight training machine 999. In this weight training machine 999, the moment arm weight resistance mechanism 300 is shown mounted pointed frontward.

FIG. 7 is a side view of the weight training machine 999 shown in FIG. 6 comprising an embodiment of the moment arm weight resistance mechanism 300 of the present invention in the operating mode, that is, with the user lifting weight. Similar to as disclosed in connection with FIG. 4, the user (not shown) sits on the seat 991 of weight training machine 999 in the known manner, with the user gripping the actuating means 14. When the user actuates (moves) on the actuating means 14, main cable 302 is pulled with the ultimate result of pulling upwards on cam 312, thus rotating cam 312. As cam 312 is attached to moment arm 314, moment arm 314 also is rotated upwards, causing the moment about pivot point 322 and weight resistance against cable 302. By pulling and releasing actuating means 14, the user causes the upward and downward rotation of moment arm 314, and obtains a weight resistance workout.

FIG. 8 is a perspective view of a third representative weight training machine 999 comprising an embodiment of the moment arm weight resistance mechanism 300 of the present invention in the resting mode, that is, with the user at rest. This weight training machine 999 is a combination multi-station and multi-function combination weight training machine for exercising all major muscle groups. Similar to as disclosed in connection with FIG. 3, moment arm weight resistance mechanism 300 is pivotally attached to weight training machine 999 such that when activated, moment arm 314 can pivot or swing upwards and downwards without any or undue hindrance by any components of weight training machine 999. Pivot rod 252 is pivotally mounted on the frame 997 of weight training machine 999. In this weight training machine 999, the moment arm weight resistance mechanism 300 is shown mounted pointed sideward.

FIG. 9 is a perspective view of the weight training machine shown in FIG. 8 comprising an embodiment of the moment arm weight resistance mechanism of the present invention in the operating mode, that is with the user lifting weight. Similar to as disclosed in connection with FIG. 4, the user (not shown) sits on the seat 991 of weight training machine 999 in the known manner, with the user gripping the actuating means 14A, 14B or with the user's legs contacting the actuating means 14C. Weight training machine 999 also has a backrest 989. When the user actuates (moves) the actuating means 14A, 14B, or when the user lifts his or her legs so as to pivot the actuating means 14C upwards, main cable 302 is pulled with the ultimate result of pulling upwards on cam 312, thus rotating cam 312. When the user pulls down on the actuating means 14, main cable 302 is pulled with the ultimate result of pulling upwards on cam 312, thus rotating cam 312. As cam 312 is attached to moment arm 314, moment arm 314 also is rotated upwards, causing the moment about pivot point 322 and weight resistance against cable 302. By pulling and releasing actuating means 14, the user causes the upward and downward rotation of moment arm 314, and obtains a weight resistance workout.

FIG. 10 is a side view of an embodiment of a cable 302 and pulley 304 configuration for a multi-function weight training machine 999 as shown in FIGS. 8 and 9, comprising an embodiment of the moment arm weight resistance mechanism 300 of the present invention. This configuration is known in the industry.

FIG. 11 is a top view of an alternate embodiment of the moment arm weight resistance mechanism 300 of the invention. This embodiment of moment arm weight resistance mechanism 300 comprises cam 312, moment arm 314, weight 316, weight adjusting drive 318, weight adjusting means support 320, pivot point 322, and weight adjusting motor 324. Moment arm 314 is pivotally secured about pivot point 322 and extends generally normal to the pivot axis of pivot point 322. Thus, moment arm 314 acts as a cantilever extending from pivot point 322, and moment arm 314 can rotate about the pivot axis of pivot point 322. In this embodiment, moment arm 314 is a generally flat runway on which weight 316 can roll and can be termed an open arm embodiment.

FIG. 11 illustrates the weight adjusting motor 324 mounted to the side of the moment arm 314, such as on the moment arm pivot rod 252. Weight adjusting drive 318 is a cable, wire, chain, belt, or other flexible material extending around pulleys 320A, which act as the de facto weight adjusting drive supports. Weight 316 is attached to the wire of weight adjusting drive 318. Weight adjusting motor 324 turns one of the pulleys 320A, which causes the movement of the weight adjusting drive 318 about the pulleys 320A, thus moving the weight 316 along or relative to the moment arm 314 in either direction.

FIG. 12 is a side view of the alternate embodiment of the moment arm weight resistance mechanism 300 shown in FIG. 11.

FIG. 13 is a side view of another alternate embodiment of the moment arm mechanism 300 of the invention. This embodiment has the weight adjusting motor 324 located within a cart 334, and with weight 316 attached to the cart 334. Weight adjusting drive 318 again is a screw, but this time journaled between two weight adjusting drive supports 320 located on opposite ends of the moment arm 314. Weight adjusting motor 324 cooperates directly with weigh adjusting drive 318, such that when weight adjusting motor 324 is actuated, a threaded passage within weight adjusting motor 324 cooperates with the external screw thread of weight adjusting drive 318, and weight adjusting motor 324 moves along weight adjusting drive 318. Being in a cart 334 with wheels 332 allows weight adjusting motor 324 and attached weight 316 to move along or relative to moment arm 314.

FIG. 14 is a side view of another weight training machine 999 comprising an embodiment of the moment arm weight resistance mechanism 300 of the present invention in the resting mode, that is, with the user at rest. FIG. 14 is a leg extension machine 999 similar to that shown in FIG. 3, but with the cable 302 attached to a cable attachment means 400 rather than cooperating with a cam 312. This weight training machine 999 is a leg extension quadriceps machine. Moment arm weight resistance mechanism 300 is pivotally attached to the back side of weight training machine 999 such that when activated, weight resistance mechanism 300 and moment arm 314 can pivot or swing upwards and downwards without any or undue hindrance by any components of weight training machine 999. Pivot rod 252 is pivotally mounted on the frame 997 of weight training machine 999, such as on brackets 995. Brackets 995 can have bearings (not shown) to reduce friction and/or to better hold pivot rod 252. Stop 993 provides a place for weight resistance mechanism 300 to rest or sit when not in use, and prevents weight resistance mechanism 300 from traveling downward more than a suitable distance.

FIG. 14 illustrates an exemplary configuration of main cable 302 and pulleys 304 operatively connecting actuating device 14 to moment arm weight resistance mechanism 300. Main cable 302 attaches to actuating device 14, such as by cable attachment means 400, and travels through or about frame 997 via pulleys 304, ultimately to moment arm weight resistance mechanism 300. Main cable 302 can travel through frame 997 for aesthetic and safety purposes. In the embodiment shown, cable 302 attaches to cable attachment means 400. In this weight training machine 999, the moment arm weight resistance mechanism 300 is shown mounted pointed rearward.

FIG. 15 is a side view of the weight training machine 999 shown in FIG. 14 comprising an embodiment of the moment arm weight resistance mechanism 300 of the present invention in the operating mode, that is, with the user is exercising on the weight training machine 999. The user (not shown) sits on the seat 991 of weight training machine 999 in the known manner, with the user's legs contacting the actuating means 14. Weight training machine 999 also has a backrest 989. When the user actuates (moves, such as by lifting his or her lower legs so as to pivot) the actuating means 14 upwards, main cable 302 is pulled with the ultimate result of pulling upwards on cable attachment means 400, thus rotating weight resistance mechanism 300 upwards, causing the moment about pivot point 322 and weight resistance against cable 302. By lifting and lowering actuating means 14, the user causes the upward and downward rotation of weight resistance mechanism 300 and moment arm 314, and obtains a weight resistance workout.

FIG. 16 is a side view of another weight training machine 999 comprising an embodiment of the moment arm weight resistance mechanism 300 of the present invention in the resting mode, that is, when the user is at rest. FIG. 16 is a leg extension quadriceps machine 999 similar to that shown in FIG. 3, but with a bar linkage mechanism 430 rather than a cable 302 or a cam 312. Moment arm weight resistance mechanism 300 is pivotally attached to the back side of weight training machine 999 such that when activated, weight resistance mechanism 300 and moment arm 314 can pivot or swing upwards and downwards without any or undue hindrance by any components of weight training machine 999. Pivot rod 252 is pivotally mounted on the frame 997 of weight training machine 999, such as on brackets 995. Brackets 995 can have bearings (not shown) to reduce friction and/or to better hold pivot rod 252. Stop 993 provides a place for weight resistance mechanism 300 to rest or sit when not in use, and prevents weight resistance mechanism 300 from traveling downward more than a suitable distance.

FIG. 16 illustrates an exemplary configuration of bar linkage mechanism 430 operatively connecting actuating device 14 to moment arm weight resistance mechanism 300. First bar 432 comprises two ends, a first of which is pivotally attached to actuating device 14, such as by pivot point bracket 400A. First bar 432 is illustratively shown as a straight bar, but can be of other configurations. Second bar 434 comprises two ends and is pivotally attached at a central location to frame 997, such as by bearings 440 and/or journals 442. A first end of second bar 434 is pivotally attached to a second end of first bar 432, and a second end of second bar 434 is pivotally attached to a first end of third bar 436. Second bar 434 is illustratively shown as an L-shape with the vertex of the L pivotally attached to frame 997, but second bar 434 can be of other configurations. Third bar 436 comprises two ends, a first of which is pivotally attached to a second end of second bar 434 and a second of which is pivotally attached to a first end of fourth bar 438. Third bar 436 is illustratively shown as a straight bar, but can be of other configurations. Fourth bar 438 comprises two ends, a first of which is pivotally attached to a second end of third bar 436 and a second of which is rigidly attached to weight resistance mechanism 300. Alternatively, fourth bar 438 can be a structural extension of weight resistance mechanism 300 and not necessarily a separate component. In this weight training machine 999, the moment arm weight resistance mechanism 300 is shown mounted pointed rearward.

FIG. 17 is a side view of the weight training machine 999 shown in FIG. 16 comprising an embodiment of the moment arm weight resistance mechanism 300 of the present invention in the operating mode, that is, when the user is exercising on the machine 999. The user (not shown) sits on the seat 991 of weight training machine 999 in the known manner, with the user's legs contacting the actuating means 14. Weight training machine 999 also has a backrest 989. When the user actuates (moves, such as by lifting his or her lower legs so as to pivot) the actuating means 14 upwards, first bar 432 is pulled forwards with the result of pulling and thus rotating second bar 434 about the central attachment to frame 997. As second bar 434 rotates, second bar 434 causes third bar 436 to move and to act on fourth bar 438 in a manner causing the rotation of fourth bar 438 and weight resistance mechanism 300 about pivot point 322, thus rotating weight resistance mechanism 300 and moment arm 314 upwards, causing the moment about pivot point 322 and weight resistance against and through bar linkage mechanism 430 to actuating means 14 and therefore to user. By lifting and lowering actuating means 14, the user causes the upward and downward rotation of weight resistance mechanism 300 and moment arm 314, and obtains a weight resistance workout. One alternative of this embodiment comprises a first bar 432 and a second bar 434 as disclosed, with weight resistance mechanism 300 attached directly and preferably rigidly to a second end of second bar 434. Second bar 434 may need to be mounted somewhat higher on frame 997 than shown in FIGS. 16 and 17 to allow sufficient clearance for weight resistance mechanism 300 to rotate upwards and downwards. The use of a greater or lesser number of linkage bars can be determined by one of ordinary skill in the art without undue experimentation.

FIG. 18 is a side view of another weight training machine 999 comprising an embodiment of the moment arm weight resistance mechanism 300 of the present invention in the resting mode, that is, when the user is at rest. FIG. 18 is a combination leg extension quadriceps and torso rotational crunch machine. This embodiment further comprises an additional bar linkage mechanism 430A comprising a fifth bar 444, the fifth bar 444 comprising two ends, a first of which is pivotally attached to frame 997, preferably proximal to headrest 987, such as by pivot point bracket 400A, and a second of which is pivotally attached to a second end of fourth bar 438. Fifth bar 444 is illustratively shown as a straight bar, but can be of other configurations. In this embodiment, fourth bar 438 comprises two ends, a first of which is pivotally attached to a second end of third bar 436 and a second of which is pivotally attached to a second end of fifth bar 444. In this embodiment, a central portion of fourth bar 438 is rigidly attached to weight resistance mechanism 300. Alternatively, fourth bar 438 can be a structural extension of weight resistance mechanism 300 and not necessarily a separate component. In this weight training machine 999, the moment arm weight resistance mechanism 300 is shown mounted pointed rearward.

FIG. 19 is a side view of the weight training machine 999 shown in FIG. 18 comprising an embodiment of the moment arm weight resistance mechanism 300 of the present invention in the operating mode, that is, when the user is exercising on the machine 999. To use as a leg extension quadriceps machine, the user operates the machine as disclosed in connection with FIGS. 17 and 18. To use as a torso rotational crunch machine, the user (not shown) sits on the seat 991 of weight training machine 999 in the known manner, preferably with the user leaning against headrest 987 and backrest 989, and with the user's hands grasping the actuating means 14C. When the user actuates (moves, such as by pulling his or her arms so as to pivot) the actuating means 14 forwards and downwards, fifth bar 444 is pulled and rotated forwards with the result of acting on fourth bar 438 in a manner causing the rotation of fourth bar 438 and weight resistance mechanism 300 about pivot point 322, thus rotating weight resistance mechanism 300 and moment arm 314 upwards, causing the moment about pivot point 322 and weight resistance against and through additional bar linkage mechanism 430A to actuating means 14C and therefore to user. By pulling and releasing actuating means 14C, the user causes the upward and downward rotation of weight resistance mechanism 300 and moment arm 314, and obtains a weight resistance workout. To use as a simultaneous combination leg extension quadriceps machine and torso rotational crunch machine, the user operates the machine as disclosed in connection with both FIGS. 16 and 17 and with FIGS. 18 and 19 by actuating both actuating means 14 with the legs and actuating means 14C with the arms. The use of a greater or lesser number of linkage bars can be determined by one of ordinary skill in the art without undue experimentation.

FIG. 20 is a side view of another weight training machine 999 comprising an embodiment of the moment arm weight resistance mechanism 300 of the present invention in the resting mode, that is, when the user is at rest. FIG. 20 is a combination lower back and triceps press machine with a bar linkage mechanism 430 rather than a cable 302 or a cam 312. FIG. 20 illustrates an exemplary configuration of bar linkage mechanism 430 operatively connecting frame 997, which serves as actuating device 14 in this embodiment, to moment arm weight resistance mechanism 300. First bar 462 comprises two ends, a first of which is pivotally attached to frame 997, such as by bracket 995, proximal to backrest 989. First bar 462 is illustratively shown as a straight bar, but can be of other configurations. Second bar 464 comprises two ends, a first of which is pivotally attached to a second end of first bar 462 and a second of which is rigidly attached to weight resistance mechanism 300 at the pivot point 322. Alternatively, second bar 462 can be a structural extension of weight resistance mechanism 300 and not necessarily a separate component, whereby second bar 462 and weight resistance mechanism 300 can be structured in and act in the manner of a lever. In this weight training machine 999, the moment arm weight resistance mechanism 300 is shown mounted pointed rearward.

FIG. 20 illustrates moment arm weight resistance mechanism 300 pivotally attached to the back side of weight training machine 999 via second bar 464 such that when activated, weight resistance mechanism 300 and moment arm 314 can pivot or swing upwards and downwards without any or undue hindrance by any components of weight training machine 999. Pivot rod 252 is pivotally mounted on or through the frame 997 of weight training machine 999 so as to pivotally connect second arm 464 to frame 997. Bearings (not shown) can be used to reduce friction and/or to better hold pivot rod 252. Stop 993 provides a place for weight resistance mechanism 300 to rest or sit when not in use, and prevents weight resistance mechanism 300 from traveling downward more than a suitable distance.

FIG. 20 also illustrates two different embodiments of the invention, an embodiment where extensions 983 rigidly attached to frame 997 and an embodiment where extensions 983 are rigidly attached to weight resistance mechanism 300 and pivotally attached to frame 997. In the first embodiment, handles 985 are primarily for grasping and pushing against, so as to provide a base for pushing against backrest 989. In a second embodiment, handles 985 also allow for an additional means for lifting weight resistance mechanism 300 and an additional exercise for the arms.

FIG. 21 is a side view of the weight training machine 999 shown in FIG. 20 comprising an embodiment of the moment arm weight resistance mechanism 300 of the present invention in the operating mode, that is, when the user is exercising on the machine 999. The user (not shown) sits on the seat 991 of weight training machine 999 in the known manner, with the user's hands contacting the handles 985. When the user actuates (moves, such as by pushing backwards against backrest 989 so as to pivot) the backrest 989 backwards, first bar 462 is pushed backwards and downwards with the result of pushing and thus rotating second bar 464 about the central attachment to frame 997. As second bar 464 rotates, weight resistance mechanism 300 pivots about pivot point 322, thus rotating weight resistance mechanism 300 and moment arm 314 upwards, causing the moment about pivot point 322 and weight resistance against and through bar linkage mechanism 430 to backrest 989 and therefore to the user. By pushing against and releasing backrest 989, the user causes the upward and downward rotation of weight resistance mechanism 300 and moment arm 314, and obtains a weight resistance workout. The use of a greater or lesser number of linkage bars can be determined by one of ordinary skill in the art without undue experimentation.

FIG. 21 also illustrates embodiments of handles 985. In a first embodiment, handles 985 are rigidly attached to frame 997 via extensions 983. In this first embodiment, handles 985 are primarily for grasping and pushing against, so as to provide a base for pushing against backrest 989. In a second embodiment, handles are pivotally attached to frame 997 at pivot point 322 and are rigidly attached to weight resistance mechanism 300. In this second embodiment, handles 985 also allow for an additional means for lifting weight resistance mechanism 300 and an additional exercise for the arms. In this second embodiment, extensions 983 and second bar 464 pivot together and both about pivot point 322 as both are rigidly attached to weigh resistance mechanism 300.

FIG. 22 is a first perspective view of an alternate embodiment of the moment arm weight resistance mechanism 300 of the invention showing basic working elements of the invention. This embodiment of moment arm weight resistance mechanism 300 comprises moment arm 314, weight 316, weight adjusting drive 318, pivot point 322, weight adjusting motor 324, and cable attachment means 400. Weight resistance mechanism 300 is pivotally secured about pivot point 322, about which the moment is created, and extends generally normal to the pivot axis of pivot point 322. Thus, weight resistance mechanism 300 in general and moment arm 314 in particular acts as a cantilever extending from pivot point 322, and weight resistance mechanism 300, including moment arm 314 and other components of weight resistance mechanism 300, can rotate about the pivot axis of pivot point 322. Weight resistance mechanism 300 is pivotally attached to a bracket 406 that is attached to the frame of the weight training machine 999. In this embodiment, moment arm 314 is a generally rod-like structure on which weight 316 can slide and can be termed an open arm embodiment.

FIG. 22 also illustrates that, in this embodiment, moment arm 314 is a generally solid, elongated, rod-like structure. Weight adjusting drive 318 is located below and parallel to moment arm 314, both being attached to supports 408, 410. Weight 316 is slidably mounted on moment arm 314 and drivably mounted on weight adjusting drive 318. Weight adjusting motor 324 is shown mounted on support 408 and operatively connected to weight adjusting drive via gear box 412. Moment arm 314 is illustratively shown as being rigidly connected to supports 408, 410, but moment arm 314 can be secured to supports 408, 410 by any known or suitable means. Similarly, weight adjusting drive 318 is illustratively shown as being rotationally connected to supports 408, 410.

FIG. 22 illustrates that weight 316, or a portion or component of weight 316, comprises an internal passage 352 comprising a screw thread 354. The structure of the internal passage 352 and associated components 350, 354, 356 can be the same as that disclosed in connection with FIG. 2, or internal passage 352 can simply comprise a hole with screw thread 356 about the diameter of the hole. In this embodiment of weight 316, weight 316 comprises an additional internal passage 402 through which moment arm 314 passes, and which supports moment arm 314. The diameter of additional internal passage 402 is greater than the outer diameter of the moment arm 314 such that weight 316 can slide over moment arm 314. One or more bearings 404, such as for example low-friction material washers or roller bearings, are inserted into additional internal passage 402 and secured by known means to allow weight 316 to slide more easily on moment arm 314. Weight adjusting drive 318, and particularly the screw thread 354 of weight adjusting drive 318 cooperates with the screw thread 356 of weight 316 such that when weight adjusting drive 318 is rotated, as disclosed herein, weight 316 will move relatively along weight adjusting drive 318.

FIG. 22 illustrates weight adjusting drive 318 as a screw journaled to support 410 and operatively connected to gear box 412 at support 408, with supports 408, 410 being located on opposite ends of the moment arm 314. Weight adjusting motor 324 cooperates directly with weigh adjusting drive 318 via gear box 412, such that when weight adjusting motor 324 is actuated, weight adjusting drive 318 is rotated via gearing in gear box 412. Thus, depending on the direction of motion of weight adjusting motor 324, weight adjusting drive 318 will rotate in one direction or the other, thus causing weight 316 to move in one direction or the other along weight adjusting drive 318 and moment arm 314. As weight 316 moves away from pivot point 322, the moment increases, thus increasing the relative weight applied to the user.

FIG. 23 is a second perspective view of the alternate embodiment of the moment arm weight resistance mechanism 300 shown in FIG. 22. The structural relationship of pivot point 322 can be seen in better detail in this view. The structure of an illustrative embodiment of weight 316 also can be seen in better detail in this view. Weight 316 can comprise a single mass or can comprise two or more plates 316A, 316B. In this view, weight 316 comprises one drive plate 316A and several non-drive plates 316B. Drive plate 316A can comprise additional internal passage 402 and thread 356 to cooperate with weight adjusting drive 318, while non-drive plates 316B can be shaped so as to not cooperate or even contact weight adjusting drive 318. In this multi-plate configuration, weight 316 can be adjusted to have more or less mass as desired.

Although moment arm 314 is shown on the back of the weight training machine 999 and extending either backward, frontward, or from side to side in several of the illustrative examples, the location of moment arm weight resistance mechanism 300 can be changed depending on the desired footprint, function, and/or aesthetics of the weight training machine 999 with relocation of the various operating components, such as cable 302, pulleys 304, and linkages 432, 434, 436, 438, 444, 462, 464.

In the closed arm embodiment illustrated in FIG. 1, moment arm weight resistance mechanism 300 illustratively comprises cam 312, moment arm 314, weight 316, weight adjusting drive 318, pivot point 322 (corresponding to the end of the moment arm pivot rod 252), and weight adjusting motor 324. In this embodiment, moment arm 314 can be an elongated hollow box-like structure containing weight 316, weight adjusting drive 318, and weight adjusting motor 324. This embodiment is more self-contained than the open arm embodiment disclosed herein and can help prevent outside interference with the movement of weight 316 and the operation of weight adjusting drive 318 and weight adjusting motor 324.

In the closed arm embodiment, weight adjusting drive 318 is operatively connected to weight adjusting motor 324 and to weight 316 and can be used to transfer the motion generated by weight adjusting motor 324 to weight 316 and move weight along moment arm 314. In the illustrative examples shown, weight adjusting drive 318 is a linear screw attached at one end to weight adjusting motor 324 and is free-floating at another end. Weight adjusting motor 324, in this example, turns weight adjusting device 318, which in turn cooperates with a complimentary internal threaded passage or a combination of an internal passage 352 and threaded nut 350, on weight 316 so as to move weight 316 back and forth along moment arm 314. Weight adjusting drive 318 is located generally parallel with and slightly offset from moment arm 314.

In the open arm embodiment illustrated in FIG. 3, moment arm weight resistance mechanism 300 illustratively comprises cam 312, moment arm 314, weight 316, weight adjusting drive 318, weight adjusting means support 320, pivot point 322 (corresponding to the axis of the moment arm pivot rod 252), and weight adjusting motor 324. In this embodiment, moment arm 314 can be a rod or tube, hollow or solid, having a rectangular cross-section, or at least a flat upper surface 328. Alternatively, moment arm 314 can have an I-beam structure, be a flat planar structure, or any equivalent structure that can support weight 316, allow the operative attachment of weight adjusting drive 318 to weight 316, and provide for attachment to moment arm pivot rod 252.

In this open arm embodiment, weight adjusting drive 318 is operatively connected to weight adjusting motor 324 and to weight 316 and can be used to transfer the motion generated by weight adjusting motor 324 to weight 316 and move weight along moment arm 314. In the illustrative example shown, weight adjusting drive 318 is a linear screw attached at one end to weight adjusting motor 324 and attached at another end to weight adjusting drive support 320. Specifically, weight adjusting drive support 320 is journaled into weight adjusting drive support 320 via a bearing, a low friction device, or the equivalent. Weight adjusting motor 324, in this example, turns weight adjusting device 318, which in turn cooperates with a complimentary internal threaded passage on weight 316 or a combination of an internal passage 352 and threaded nut 350, so as to move weight 316 back and forth along moment arm 314. Weight adjusting drive 318 is located generally parallel with and slightly offset from moment arm 314.

In the open arm embodiment illustrated in FIGS. 22 and 23, moment arm weight resistance mechanism 300 illustratively comprises cable attachment means 400, moment arm 314, weight 316, weight adjusting drive 318, weight adjusting means support 320, pivot point 322 (corresponding to the axis of the moment arm pivot rod 252), and weight adjusting motor 324. In this embodiment, moment arm 314 can be a rod, hollow or solid, having any cross-section that can be made to slide through additional internal passage 402.

In this open arm embodiment, weight adjusting drive 318 is operatively connected to weight adjusting motor 324 via gear box 412 and to weight 316 via threads 354, 356 and can be used to transfer the motion generated by weight adjusting motor 324 to weight 316 and move weight 316 along moment arm 314. In the illustrative example shown, weight adjusting drive 318 is a linear screw pivotally attached at one end to supports 410, and at the other end to gear box 412. Weight adjusting motor 324, in this example, turns weight adjusting device 318 via gear box 412, which in turn cooperates with a complimentary internal threaded passage 352 on weight 316 or a combination of an internal passage 352 and threaded nut 350 or a thread 356, so as to move weight 316 back and forth along moment arm 314. Weight adjusting drive 318 is located generally parallel with and slightly offset from moment arm 314.

Weight adjusting motor 324 can be a bidirectional electric motor secured on the upper surface of moment arm 314 or on the weight resistance mechanism 300. Preferably, weight adjusting motor 324 is located proximal to the pivot point 322 as weight adjusting motor 324 does have some weight and, if located on the free end 330 of moment arm 314, would impart a certain amount of weight to moment arm 314 creating an increased base moment about pivot point 322. Weight adjusting motor 324 can be selected to move weight 316 relative to or along moment arm 314 away from or towards pivot point 322, and therefore must be of sufficient power to accomplish this task. Alternatively, weight adjusting motor 324 can be mounted outside of moment arm 314 and a hole can be located on the end of moment arm 314 to allow weight adjusting drive to extend therethrough and into the interior of moment arm 314 to cooperate with weight 316.

Weight 316 can be any structure having mass. In one illustrative example shown, weight 316 is a solid mass having an internal threaded passage extending from a first side to an opposite second side or a combination of an internal passage 352 and threaded nut 350. Internal threaded passage or nut 350 cooperates with the screw thread on weight adjusting drive such that when weight adjusting drive is turned or rotated by weight adjusting motor 324, weight 316 is forced to move linearly. Weight 316 can comprise optional wheels 332 on the bottom and optionally on the top that cooperate with moment arm 314 to allow the easier movement of weight 316 along moment arm 314. Thus, as weight adjusting motor 324 turns weight adjusting drive 318, the complimentary screw threads cooperate and force weight 316 to move linearly along or relative to moment arm 314. In another illustrative example shown, weight 316 comprises plates 316A, 316B, with at least one plate 316 being a driven plate 316A having a thread 356 for cooperating with weight adjusting drive 318.

Weight 316 causes a moment about pivot point 322, thus urging a rotation of moment arm pivot rod 252 about its axis. In one embodiment, as moment arm pivot rod 252 is rotationally urged, cam 312 also is rotationally urged in the same direction, thus acting on cam cable 326 by pulling main cable 302 downward or at least imparting a downward tensional force on main cable 302. The tensional force on main cable 302 is imparted to actuating means 14, which imparts a pulling force or weight resistance on the user grasping the actuating means 14. In another embodiment, moment arm 314 imparts weight directly to cable 302 via cable attachment means 400, thus pulling main cable 302 downward or at least imparting a downward tensional force on main cable 302. The tensional force on main cable 302 is imparted to actuating means 14, which imparts a pulling force or weight resistance on the user grasping the actuating means 14. In yet another embodiment, moment arm 314 imparts weight directly to bar linkages 432, 434, 436, 438, 444, 462, 464, thus imparting a force to actuating means 14, which imparts a pulling or pushing force or weight resistance on the user grasping the actuating means 14 (which can be frame 997 or backrest 989 in certain embodiments), and imparting a rotational force on actuating arm 983 and handle 985.

The amount or level of force or weight resistance can be adjusted by moving the weight 316 along the moment arm 314. If the weight 316 is proximal to the pivot point 322, then the moment created by the weight 316 is minimal and therefore the amount or level of force or weight resistance imparted to the user is minimized. If the weight 316 is distal to the pivot point, then the moment created by the weight 316 is maximized and therefore the amount or level of force or weight resistance imparted to the user is maximized. Conventional controls operate the weight adjusting motor 324 so as to move the weight 316 to the desired position along the moment arm 314 for imparting the desired amount or level of force or weight resistance to the user as the user pulls or pushes on the actuating means 14. Alternatively, weight 316 can be moved manually by the user.

Main cable 302 and cam cable 326 can be of any structure, such as a rope, a chain, a belt, monofilaments, braided wires, flexible materials, and other suitable equivalents, that allow a transfer of force between actuating means 14 and moment arm weight resistance mechanism 300, and is not limited to a standard cable. As disclosed herein, main cable 302 can be directed around one or more pulleys 304 to direct or redirect main cable 302 between the actuating means 14 and the moment arm weight resistance mechanism 300, and to prevent main cable 302 from becoming entangled in the internal mechanical components of weight training machine 999. Thus, in operation, when user pulls or moves actuating means 14, this force transfers to main cable 302, which in turn acts on moment arm weight resistance mechanism 300 by lifting moment arm 314, thus creating the moment due to the weight of the weight 316 (and the moment arm itself, as well as any components on or attached to the moment arm 314). Alternatively, main cable 302 can be connected directed to cam 312 without the need for cam cable 326.

Pulleys 304 can be fixed class 1 pulleys that are mounted on a frame of the weight training machine 999 to direct and redirect the force of main cable 302 and do not move, except to rotate as main cable 302 moves over them. Alternatively, one or more of pulleys 304 can be a movable class 2 pulley to transform the force of main cable 302 to cam 312. Although all pulleys 304 can be fixed pulleys or movable pulleys, or a combination of fixed and movable pulleys, depending on the relative force needed to operate the moment arm weight resistance mechanism 300, the combination of fixed and movable pulleys provides a suitable transformation of the user's U energy to the actuation of the moment arm weight resistance mechanism 300.

Bar linkages 432, 434, 436, 438, 444, 462, 464 can be of any rigid structure, such as a bar, rod, or tube, and other suitable equivalents, that allow a transfer of force between actuating means 14 and moment arm weight resistance mechanism 300, and is not limited to a standard bar.

The degree of weight resistance can be controlled by user. At settings in which weight 316 is creating a moment on moment arm 314 about pivot point 322, user would be subject to weight resistance and the exercise regimen would be similar to conventional electronic, stack or free weight exercise machines, for example. The higher the setting of the moment arm weight resistance mechanism 300 (that is, with weight 316 further from pivot point 322), the heavier the weight resistance. With this arrangement, it is therefore possible to vary the weight resistance during the exercise regimen.

A comparison of the position of actuating means 14 shows how actuating means 14 can move. Actuating means 14 is shown in the at rest position in FIGS. 3, 6, 9, 13, 15, 17, and 19 and in the operational position (partially extended) in FIGS. 4, 7, 10, 14, 16, 18, and 20. Actuating means 14 can move between the at rest position and a fully extended position, and the position of actuating means 14 during operation is dependent on user. Optional stops (not shown) can prevent actuating means 14 from moving past the at rest position in one direction of motion and the fully extended position in the opposite direction of motion.

Various other features and elements can be included in the weight training machine 999 to compliment the moment arm weight resistance mechanism 300. For example, the moment arm weight resistance mechanism 300 can be enclosed in a structure attached to or supported by frame 997 for aesthetic and safety purposes. A second stop can be attached to frame 997 to stop the upward motion of the moment arm 314 so as to prevent over extension. Locks or stops, adjustable or otherwise, also can be added to lock the moment arm in the resting position or at any desired operating position or to limit the range of motion.

While the invention has been described in connection with certain preferred embodiments, it is not intended to limit the spirit or scope of the invention to the particular forms set forth, but is intended to cover such alternatives, modifications, and equivalents as may be included within the true spirit and scope of the invention as defined by the appended claims.

What is claimed is:

1. A weight training machine comprising a frame and a moment arm weight resistance mechanism, the moment arm weight resistance mechanism comprising:

a) a cantilevered moment arm pivotally attached to the frame at a pivot point;

b) an adjustable weight attached to the moment arm;

c) a weight adjusting drive for adjusting the adjustable weight along the moment arm;

d) an actuating means operatively connected to the moment arm weight resistance mechanism, wherein the weight on the moment arm creates a moment about the pivot point, wherein the degree of weight resistance can be controlled by a user by movement of the adjustable weight along the moment arm, wherein the moment arm weight resistance mechanism is variable for providing increased or decreased amounts of weight resistance and can be varied by a user during an exercise motion, and wherein moving the actuating means causes the pivoting of the moment arm about the pivot point thereby actuating the moment arm weight resistance mechanism.

2. The weight training machine as claimed in claim 1, further comprising a cam, wherein:

a) the cam is secured to the moment arm coaxially with the pivot point;

b) the actuating means is operatively connected to the moment arm weight resistance mechanism via the cam; and c) the moving of the actuating means causes the pivoting of the cam about the pivot point thereby causing the pivoting of the moment arm about the pivot point and the actuating of the moment arm weight resistance mechanism.

3. The weight training machine as claimed in claim 1, further comprising a cable attachment means, wherein:

a) the cable attachment means is secured on an end of the moment arm distal from the pivot point;

b) the actuating means is operatively connected to the moment arm weight resistance mechanism via the cable attachment means; and c) the moving of the actuating means causes the pivoting of the moment arm about the pivot point thereby causing the pivoting of the moment arm about the pivot point and the actuating of the moment arm weight resistance mechanism.

4. The weight training machine as claimed in claim 1, further comprising a bar linkage mechanism, wherein:

a) the actuating means is operatively connected to the moment arm weight resistance mechanism via the bar linkage mechanism; and b) the moving of the actuating means causes the pivoting of the moment arm about the pivot point thereby causing the pivoting of the moment arm about the pivot point and the actuating of the moment arm weight resistance mechanism.

5. The weight training machine as claimed in claim 1, further comprising a direct connection between the actuating means and the moment arm weight resistance mechanism, wherein:

a) the actuating means is rigidly connected to the moment arm weight resistance mechanism; and b) the moving of the actuating means causes the pivoting of the moment arm about the pivot point thereby causing the pivoting of the moment arm about the pivot point and the actuating of the moment arm weight resistance mechanism.

6. The weight training machine as claimed in claim 2, wherein the adjustable weight and the weight adjusting drive are supported on the moment arm weight resistance mechanism and the weight adjusting drive is operatively attached to the adjustable weight.

7. The weight training machine as claimed in claim 6, wherein the actuating means is movable between a first at rest position and a second fully extended position and can be maintained at any position between the first at rest position and the second fully extended position.

8. The weight training machine as claimed in claim 6, wherein the weight adjusting drive is selected from the group consisting of motors, pneumatic cylinders, hydraulic cylinders, and force generating devices.

9. The weight training machine as claimed in claim 6, wherein at least a portion of the moment arm weight resistance mechanism is pivotable about the pivot point.

10. The weight training machine as claimed in claim 3, wherein the adjustable weight and the weight adjusting drive are supported on the moment arm weight resistance mechanism and the weight adjusting drive is operatively attached to the adjustable weight.

11. The weight training machine as claimed in claim 10, wherein the actuating means is movable between a first at rest position and a second fully extended position and can be maintained at any position between the first at rest position and the second fully extended position.

12. The weight training machine as claimed in claim 10, wherein the weight adjusting drive is selected from the group consisting of motors, pneumatic cylinders, hydraulic cylinders, and force generating devices.

13. The weight training machine as claimed in claim 10, wherein at least a portion of the moment arm weight resistance mechanism is pivotable about the pivot point.

14. The weight training machine as claimed in claim 4, wherein the adjustable weight and the weight adjusting drive are supported on the moment arm weight resistance mechanism and the weight adjusting drive is operatively attached to the adjustable weight.

15. The weight training machine as claimed in claim 14, wherein the actuating means is movable between a first at rest position and a second fully extended position and can be maintained at any position between the first at rest position and the second fully extended position.

16. The weight training machine as claimed in claim 14, wherein the weight adjusting drive is selected from the group consisting of motors, pneumatic cylinders, hydraulic cylinders, and force generating devices.

17. The weight training machine as claimed in claim 14, wherein at least a portion of the moment arm weight resistance mechanism is pivotable about the pivot point.

18. The weight training machine as claimed in claim 17, wherein the adjustable weight and the weight adjusting drive are supported on the moment arm weight resistance mechanism and the weight adjusting drive is operatively attached to the adjustable weight.

19. The weight training machine as claimed in claim 17, wherein the actuating means is movable between a first at rest position and a second fully extended position and can be maintained at any position between the first at rest position and the second fully extended position.

20. The weight training machine as claimed in claim 17, wherein the weight adjusting drive is selected from the group consisting of motors, pneumatic cylinders, hydraulic cylinders, and force generating devices.

21. The weight training machine as claimed in claim 17, wherein at least a portion of the moment arm weight resistance mechanism is pivotable about the pivot point.

22. The weight training machine as claimed in claim 1, wherein the actuating means is operatively connected to the moment arm weight resistance mechanism proximal to the pivot point.

23. The weight training machine as claimed in claim 1, wherein the actuating means is operatively connected to the moment arm weight resistance mechanism distal from the pivot point.

24. The weight training machine as claimed in claim 1, further comprising at least two actuating means operatively connected to the moment arm weight resistance mechanism, wherein moving at least one of the at least two actuating means actuates the moment arm weight resistance mechanism.

25. The weight training machine as claimed in claim 24, wherein moving the at least two actuating means actuates the moment arm weight resistance mechanism.

26. The weight training machine as claimed in claim 24, wherein each of the at least two actuating means is actuated by different exercise motions.

* * * * *